US007036759B2

(12) United States Patent
Van Der Zanden

(10) Patent No.: US 7,036,759 B2
(45) Date of Patent: May 2, 2006

(54) AUTOGENOUS ROTOR

(75) Inventor: Johannes Petrus Andreas Josephus Van Der Zanden, Ring of Kerry, Dunkilla, Tahilla, Co. Kerry (IE)

(73) Assignees: Rosemarie Johanna Van Der Zanden, Co. Kerry (IE); Johannes Petrus Andreas Josephus Van Der Zanden, Co. Kerry (IE); IHC Holland N.V., Kinderdijk (NL)

( * ) Notice: Subject to any disclaimer, the term of this patent is extended or adjusted under 35 U.S.C. 154(b) by 149 days.

(21) Appl. No.: 10/399,765

(22) PCT Filed: Oct. 25, 2001

(86) PCT No.: PCT/NL01/00785

§ 371 (c)(1),
(2), (4) Date: Apr. 22, 2003

(87) PCT Pub. No.: WO02/36263

PCT Pub. Date: May 10, 2002

(65) Prior Publication Data

US 2004/0011905 A1 Jan. 22, 2004

(30) Foreign Application Priority Data

Oct. 26, 2000 (NL) ..... 1016487
Apr. 17, 2001 (NL) ..... 1017851
Apr. 25, 2001 (NL) ..... 1017934

(51) Int. Cl.
*B02C 19/00* (2006.01)

(52) U.S. Cl. ..... 241/275

(58) Field of Classification Search ..... 241/275, 241/5; 416/179, 669, 668
See application file for complete search history.

(56) References Cited

U.S. PATENT DOCUMENTS

| | | | | |
|---|---|---|---|---|
| 2,958,473 | A * | 11/1960 | Massie | 241/108 |
| 3,032,169 | A * | 5/1962 | Bridgewater | 198/642 |
| 3,168,991 | A * | 2/1965 | Herman | 241/275 |
| 3,174,697 | A | 3/1965 | Bridgewater | |
| 4,090,673 | A * | 5/1978 | Ackers et al. | 241/275 |
| 4,575,014 | A | 3/1986 | Szalanski et al. | |
| 4,940,188 | A | 7/1990 | Rodriguez et al. | |
| 5,860,605 | A * | 1/1999 | Van Der Zanden | 241/27 |
| 6,554,215 | B1 * | 4/2003 | Schultz et al. | 241/275 |
| 6,786,436 | B1 * | 9/2004 | van der Zanden | 241/5 |
| 6,802,466 | B1 * | 10/2004 | Van Der Zanden | 241/275 |

FOREIGN PATENT DOCUMENTS

| | | |
|---|---|---|
| EP | 0 835 690 A1 | 4/1998 |
| EP | 1 084 751 A1 | 3/2001 |

* cited by examiner

*Primary Examiner*—Mark Rosenbaum
(74) *Attorney, Agent, or Firm*—Young & Thompson

(57) ABSTRACT

The device relates to an autogenous rotor that rotates about an axis of rotation, which rotor is provided with at least one guide member for accelerating material, which guide member is associated with a chamber member where an autogenous bed of material builds up, with the aid of which guide member material is guided into a spiral path in the direction of the chamber member where the accelerated material impinges on the autogenous bed at a predetermined impingement location, after which the material moves from the impingement location along the autogenous bed in the direction of the tip, under the influence of centrifugal force, where the material is propelled outwards from the rotor.

49 Claims, 17 Drawing Sheets

C - C 57
55
52
51
54
274
56
53
50
39
132
224
43
45
44
40
267
46
B
B
270
41
Ω
272
42
266
49
48
47

B - B
222
40
275
44
45
μ2
50
56
128
55
133
C
C
41
57
131
130
46
266
μ1
264
265
223
268
269

G - G
257
249
254
255
244
F
F
248
256
252
251
250
258
253

F - F
249
262
247
260
259
261
246
G
G
248
250
251
245

AUTOGENOUS ROTOR

CROSS REFERENCE TO RELATED APPLICATION

This is the 35 USC 371 national stage of international application PCT/NL01/00785 filed on Oct. 25, 2001, which designated the United States of America.

FIELD OF THE INVENTION

The invention relates to the field of the acceleration of material, in particular a stream of granular or particulate material, with the aid of centrifugal force, with, in particular, the aim of causing the accelerated grains or particles to collide at such a velocity that they break.

BACKGROUND TO THE INVENTION

According to a known technique the movement of a stream of material can be accelerated with the aid of centrifugal force. With this technique the material is fed onto the central surface of a rotor and is then picked up by guide members which are arranged around said central surface and are carried by said rotor. The material is accelerated along the guide members, under the influence of centrifugal forces, and propelled outwards at high velocity and at a certain take-off angle. The velocity that the material acquires during this operation is made up of a radial velocity component and a velocity component oriented perpendicularly to the radial, or transverse velocity component. Viewed from the stationary position, the material moves at virtually constant velocity along a virtually straight as after it has left the guide member. This straight stream is directed forwards, viewed in the direction of rotation, and the magnitude of the take-off angle is in this case determined by the magnitudes of radial and transverse velocity components. If these components are identical the take-off angle is 45°. Viewed from a standpoint moving with the guide member the material moves in a spiral stream after it leaves the guide member, which spiral stream is directed backwards, viewed in the direction of rotation, and is in the extension of the release end of the guide member. In this case the relative velocity increases along said spiral path.

Guiding can take place along a metal guide surface that is oriented radially outwards. Such a guide surface is disclosed in U.S. Pat. No. 5,184,784. Autogenous guiding is also possible, along a so-called dead or autogenous bed of own material that under the influence of centrifugal force settles as a continuous layer in a chamber member that is arranged along the edge of the rotor. An autogenous rotor of this type is disclosed in U.S. Pat. No. 4,940,188 and is of particular importance with regard to the autogenous rotor according to the invention. In the known autogenous rotor the chamber member is provided with a chamber wall that is at least partially arranged tangentially and in any event does not extend in the radial direction. As a result of this tangential arrangement no, or only limited, movement forces are able to develop along the chamber wall, with the consequence that the material settles on the chamber wall. However, the chamber wall extends—increasingly radially oriented—towards the outer edge of the rotor, with the consequence that (radial) acceleration forces gradually build up towards the outside, which cause the material to move along the autogenous granular bed towards the outside. At the end of the chamber wall there is a tip over which the material is propelled outwards from the rotor, the take-off velocity being essentially determined by the transverse velocity component.

Many shapes of chamber members are conceivable and known. For instance, instead of a tangential wall, the autogenous bed can also be built up in contact with a circular chamber wall, in which case the material settles as it were in a bowl. A rotor of this type is disclosed in U.S. Pat. No. 4,575,014 and U.S. Pat. No. 1,405,151.

It is also possible to construct the rotor with symmetrical chamber members. Such a rotor is disclosed in JP 08266920. This solution has the advantage that the rotor can be rotated in both directions, as a result of which the life time of the rotor, that essentially is determined by the number of tips, is doubled.

The material propelled outwards can now be collected by a stationary impact member that is arranged in the straight sin that the material describes, with the aim of causing the material to break during the impact. The comminution process takes place during this single impact, the equipment being referred to as a single impact crusher. The stationary impact member can, for example, be formed by an armoured ring, which is arranged around the rotor. Such a device is disclosed in U.S. Pat. No. 4,690,341. It is also possible to allow material impinge autogenously on a bed of own material. Such a device is disclosed in U.S. Pat. No. 4,662,571.

Instead of allowing the material to impinge directly on a stationary impact member, it is also possible first to allow the material to impinge on an impact member that is co-rotating with the guide member and that is rotating at the same velocity, in the same direction and about the same axis of rotation, but a greater radial distance away from said axis of rotation than is said guide member, and is arranged transversely in the spiral stream which the material describes. Such equipment is referred to as a direct multiple impact crusher. Because the impact with the co-rotating impact member takes place essentially deterministically, the impact surface can be arranged at an angle such that the impact takes place at an optimum angle. Such a method and device are disclosed in PCT/NL 97/00565, which was drawn up in the name of the Applicant.

EP 1 084 751 A1, which was drawn up in the name of the Applicant, discloses a symmetrical rotor that is provided with guide members and associated impact members, a facility being provided for making the impact members partially autogenous.

The known autogenous rotor by means of which the material moves over an autogenous bed of material in the direction of the tip and from there is propelled outwards from the rotor has the advantage that wear is limited, compared with a rotor where the material is accelerated along a (more radially oriented) steel guide surface. However, the known autogenous rotors also have disadvantages. For instance, fairly substantial wear still occurs along the tip, certainly in the case of more abrasive material. Another (major) disadvantage is that the material, when it is metered onto the central surface of the rotor and moves (abrasively) outwards over the rotor blade, moves, relative to the autogenous bed, in a (spiral) direction that is opposed to the direction of rotation of said autogenous bed. In order to be picked up by the autogenous bed and then to be guided along said autogenous bed towards the edge of the rotor (tip), the direction of movement of the material must therefore be reversed through approximately 180°. This costs a great deal of energy, results in substantial wear on the rotor blades and is the reason why the flow of the material is hindered, as a result of which the capacity is substantially restricted. As a result of the reversal of the stream of material a certain degree of comminution (grinding) of the material takes place as a result of mutual friction (attrition) of the grains. This can give rise to an excess of fine particles. Furthermore, the chamber members take up a fairly large amount of space, as a result of which the space in which the material can flow through is restricted. The rotor can therefore usually be constructed with a maximum of three chamber members, which are of symmetrical or non-symmetrical construction. This limits the life time, which, incidentally, is mainly determined by the tips. Another disadvantage is that the material must not be too wet or sticky because the rotor can then clog; in any event the throughput is substantially impeded. Furthermore, the maximum grain diameter that can be processed is usually restricted to 40–50 mm.

AIM OF THE INVENTION

The aim of the invention is, therefore, to provide a simple autogenous rotor as described above that does not have the said disadvantages, or at least displays these to a lesser extent. This rotor is described in the claims.

The aim of the invention is achieved by providing the known autogenous rotor—that is provided with a chamber member in which an autogenous bed of own material settles under the influence of centrifugal force—with guide members, which are associated with said chamber member, in such a way that the metered material is guided with the aid of said guide member along a concentrated stream to the autogenous bed, which autogenous bed is now subjected to concentrated impingement at an impingement location in said autogenous bed, the position of which impingement location is determined by the arrangement of the guide member. Impingement takes place at fairly high velocity, as a result of which comminution occurs; because what is concerned here is a stone-on-stone collision no wear occurs during this collision.

What is achieved by selecting the impingement location at a location in front of the radial line from said axis of rotation with the tangential location thereon—or (even better) at a location close to or immediately behind the chamber tip—is that the stream of material has to be reversed to a lesser extent in order then to be able to be guided further towards the chamber tip. This increases the capacity, limits wear, saves energy and makes it possible to process wetter (sticky) and coarser granular material.

In contrast to the known autogenous rotor, where the material is (has to be) guided from the central surface along the rotor blade to the autogenous chamber bed, the autogenous rotor according to the invention also makes it possible to guide the material—that is accelerated with the aid of guide members—in flight (that is to say through the space without it touching the rotor blade) from the guide member to the autogenous chamber bed. For this purpose the outer edge of the central surface must be arranged at a higher level than the portion of the rotor blade outside the central surface, which is termed the edge surface here.

The autogenous rotor according to the invention thus makes it possible to achieve the objectives of the invention in a simple manner. Thus, wear on the impact member (chamber member) is appreciably reduced, comminution takes place during the impact, energy is saved, the capacity of the rotor is increased and it is possible to process wetter (sticky) and coarser material; all of this in comparison with the known autogenous rotor that is not provided with guide members. Furthermore, the specific directed impact of the stream of material on the autogenous chamber bed produces a certain degree of refreshment of the bed of material, which as a result remains of coarser composition (compared with the bed of material in the known autogenous rotor), which improves the intensity of comminution. The rotor according to the invention also makes it possible continuously to refresh the autogenous chamber bed, which is achieved by feeding a portion of the metered material to the autogenous chamber bed at a feed location behind said impingement location (viewed in the direction of rotation). This is achieved by continuing the chamber wall, and thus the autogenous chamber bed, backwards in such a way that a second stream of material that is guided outwards from behind the guide member impinges on this autogenous chamber bed located at the back, at a (predetermined) feed location at a location behind the (first) impingement location, viewed in the direction of rotation. This material then moves along the autogenous chamber bed located at the back in the direction of the (first) impingement location where it is struck (directly) by the stream of material that is directed onto said (first) impingement location, by means of which an extremely intensive stone-on-stone impact is achieved. This improves the intensity of comminution because the autogenous impact surface at the location of the first impingement location is continually refreshed with raw material and therefore it is not possible for a stationary pulverised autogenous impact bed, which substantially reduces the impact force, to form.

The material can be fed to the autogenous chamber bed located at the back with the aid of a (second) guide member located at the back, but can also be fed to this bed in a "natural" manner by movement of the material from the central surface along the rotor blade (edge surface) towards the outside. In the case of a second guide member (located at the back) it is possible with this arrangement so to arrange the guide members that the amounts of material that are fed to the autogenous chamber bed by means of the respective guide members can be accurately controlled. This can be achieved with the aid of the spacing between the locations (central feed) where the material is fed to the guide members and with the aid of the radial distance of these central feed locations from the axis of rotation.

A further aim of the invention is further to increase the intensity of comminution during the impact with the autogenous chamber bed. This aim is achieved by arranging an impact member in the autogenous chamber bed, the metal impact surface of which impact member is oriented transversely to the spiral stream in such a way that some of the material impinges on the chamber bed of own material and some of the material impinges (mainly) on the impact plate. This results in a sort of hybrid action, by means of which the intensity of comminution is increased whilst wear is limited. To this end the rotor according to the invention provides a possibility for arranging an impact block in the chamber member, the impact surface of which impact block is oriented transversely to the spiral stream. The impact block can be so sized and arranged that it is in the extension of the spiral path and receives the bulk of the material for impact. The autogenous chamber bed then collects material that misses the impact surface of the impact block and at the same time protects the suspension construction. This applies in particular for material that impinges underneath and over the top of the impact surface; it is clear that impact plates can be arranged in the same way. Following the impact on the impact surface the material moves along the autogenous chamber bed located alongside (in front of) it, which autogenous chamber bed extends towards the chamber tip over which the material is propelled outwards. In this context the invention provides a possibility for said impact block to extend outwards, as it were transversely through the autogenous chamber bed, so that the block can wear through without the rotor (chamber wall) or the block suspension construction being damaged.

A further aim of the invention is to increase the number of chamber members to at least four, by means of which the life time is further prolonged. Said aim is achieved by equipping the guide members with guide surfaces that are oriented forwards and that as far as possible are in the extension of the spiral path that the metered material describes on the central surface of the rotor (viewed from a standpoint moving with the rotor). On the other hand, this makes it possible to make the rotor of compact construction, that is to say with a diameter that is not too large.

Furthermore, the chamber members can be constructed such that they are mirror symmetrical, each with a chamber member directed forwards and a chamber member directed backwards, viewed in the direction of rotation, each provided with a chamber tip. This doubles the life time. With this arrangement the guide members are, of course, also of symmetrical construction—preferably cylindrical or elliptical (semicircular)—the guide surfaces being directed forwards, viewed in the direction of rotation, as a result of which the space for passage between the guides is maximum. The space in the rotor is thus utilised to the optimum, as a result of which the efficiency of the rotor is essentially doubled. The invention provides a possibility for providing both chamber members with impact plates or impact blocks which optionally can also be of symmetrical construction.

Incidentally it is the case that the greatest capacity is achieved with fewer—preferably two—chamber members because this yields a maximum space for passage between the guide members. However—as has been stated—this limits the life time. In order still to achieve a reasonable life time with such a configuration it is therefore preferable to construct such a rotor with two symmetrical chamber members, so that the rotor can be operated in both directions of rotation.

Another aim of the invention is to restrict the wear on the chamber tip, or at least to increase the life time of the chamber tip. This aim is achieved by making up the chamber tip from several layers of wear-resistant material located at an inclination one on top of the other, which layers, however, have different wear resistances; that is to say that the wear layer with the lowest wear resistance is located between two layers of material with greater wear resistance, etc. Usually 3 to 5 (7) wear layers are stacked at an inclination on top of one another as a sandwich in this way. Such a construction has the advantage that it is not possible—or at least very difficult—for grooves to form in which wear becomes increasingly concentrated.

The invention furthermore provides a possibility for the rotor to be constructed as a single rotor blade on which the guide members and the chamber members are arranged, it being preferable to provide the chamber members with a cover plate, and for the rotor to be constructed as two parallel rotor blades between which the guide members and the chamber members extend.

Finally, the invention provides a possibility for constructing the chamber wall as a closed drum (for example cylindrical), as a result of which a sort of autogenous drum is produced, ejection openings being made in the walls in front of and alongside the chamber tips.

BRIEF DESCRIPTION OF THE DRAWINGS

For better understanding, the aims, characteristics and advantages of the invention which have been discussed, and other aims, characteristics and advantages of the invention, are explained in the following detailed description of the device of the invention in relation to accompanying diagrammatic drawings.

BEST WAY OF IMPLEMENTING THE DEVICE OF THE INVENTION

A detailed reference to the preferred embodiments of the invention is given below. Examples thereof are shown in the appended drawings. Although the invention will be described together with the preferred embodiments, it must be clear that the embodiments described are not intended to restrict the invention to those specific embodiments. On the contrary, the intention of the invention is to comprise alternatives, modifications and equivalents which fit within the nature and scope of the invention as defined by appended claims.

Figure 1:
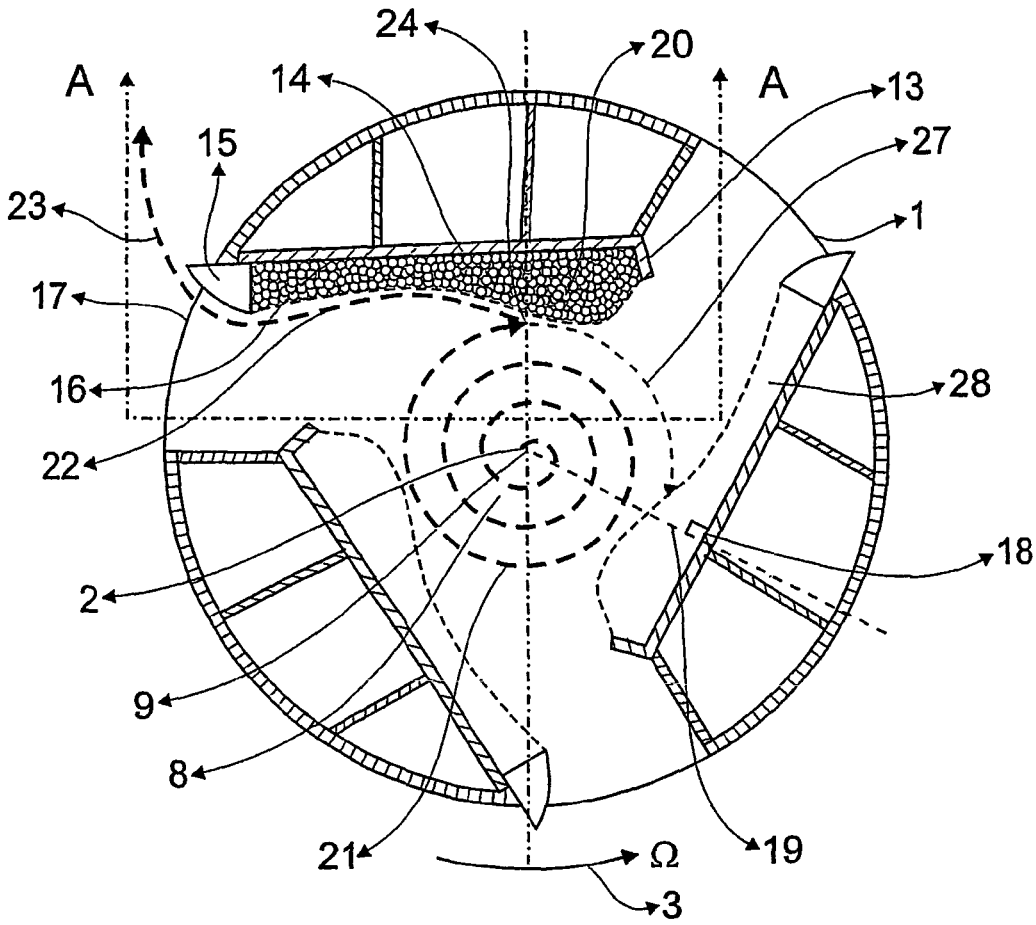
Fig. 1 (prior art)
FIG. 1 shows, diagrammatically, a longitudinal section of a known non-symmetrical autogenous rotor.
Figure 2:
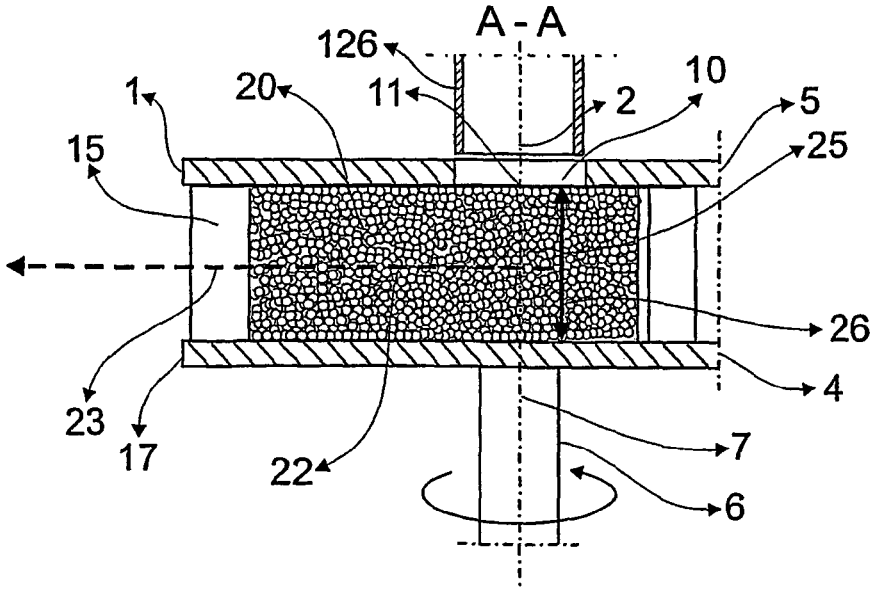
Fig. 2 (prior art)
FIG. 2 shows, diagrammatically, a cross-section (A—A) of a known non-symmetrical autogenous rotor from FIG. 1.

FIGS. 1 and 2 show, diagrammatically, a known autogenous rotor (1) that can be rotated about an axis of rotation (2) in a direction of rotation (3) and is provided with a first (4) and a second (5) rotor blade, which rotor blades (4)(5) have an essentially identical peripheral shape and are arranged in parallel and some distance apart, which first rotor blade (4) is supported on a shaft (6), the shaft axis (7) of which is coincident with said axis of rotation (2), and is provided with a circular central surface (8), the centre (9) of which is coincident with said axis of rotation (2), which second rotor blade (5) is supported, with the aid of the chamber members (13), on said first rotor blade (4) and is provided with a circular metering opening (10), the centre (11) of which is coincident with said axis of rotation (2), for metering said material, with the aid of a metering member (126), between said rotor blades (4)(5). The known autogenous rotor (1) is provided with three chamber members (13) which are carried by said rotor blades (4)(5) and are each provided with a chamber wall (14) and a tip (15), the inside (16) of which chamber wall (14), which is oriented towards the axis of rotation (2), extends perpendicularly between said rotor blades (4)(5), which inside (16) does not extend in the plane of rotation along the radial plane of symmetry from said axis of rotation (2) towards said tip (15) that is at a location close to said outer edge (17) of said rotor (1), on which inside (16), at at least one tangential location (18), the contact surface along said inside (16) of said chamber wall (14) is oriented perpendicularly to the radial plane of symmetry (19) from said axis of rotation (2), in such a way that, under the influence of centrifugal force, a continuous layer of said metered material is able to settle, as an autogenous chamber bed (20), on said inside (16) of said chamber of wall (14), which autogenous chamber bed (20) extends along said inside (16) towards said tip (15).

The direction of movement that the material that is metered onto the central surface (8) describes is important, which movement is indicated by a broken line (21)(22)(23). Here this movement must be regarded from a standpoint moving with said rotor (1); or viewed from the chamber member (13). On the central surface (8) the material describes a short spiral movement (21) in the direction that is opposed to the direction (3) of (rotary) movement of the rotor (1). As the material moves outwards along the spiral (21) said material comes into contact at some point (24) with one of the autogenous chamber beds (20) that move as a whole in an opposing direction (3) (with the rotor (1)), whilst there is also material movement (22), under the influence of centrifugal force, along the autogenous chamber bed (20) towards the tip (15), or towards the outer edge (17) of the rotor (1).

The direction of the material moving along the short spiral (21) must be reversed in order to be able to be taken up by this stream (22) of material along the autogenous chamber bed (20). This reversal (24) proceeds chaotically, the material being pushed upwards (25) and downwards (26) over the autogenous chamber bed (20) while some (27) of the material continues on to the following autogenous chamber bed (28). Under the "pressure" of the stream of material that is metered into the rotor the reversal (24) (finally) takes place and the material is—as it were—squeezed outwards along the autogenous chamber bed (20). This costs a great deal of energy, is the cause of severe wear on the rotor blades and restricts the capacity of the rotor.

Figure 3:
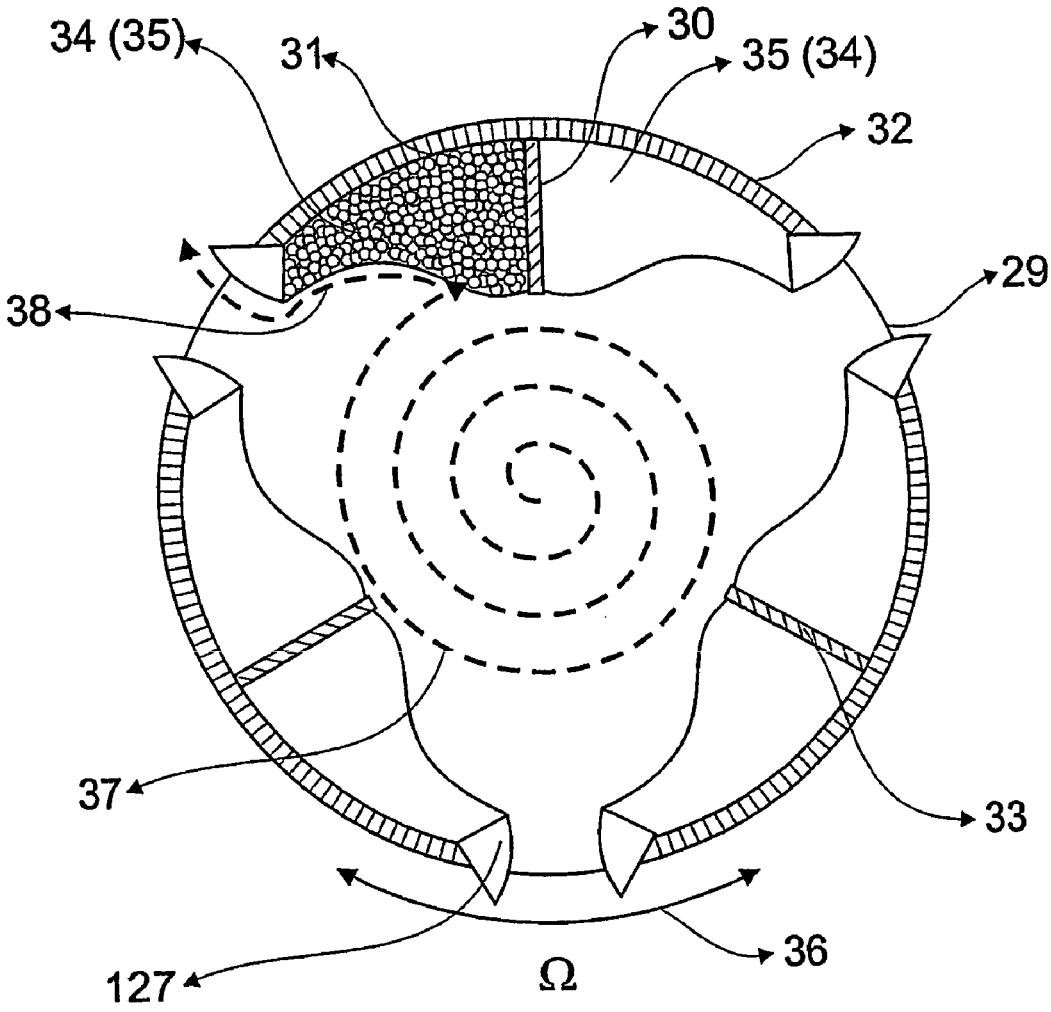
Fig. 3 (prior art)
FIG. 3 shows, diagrammatically, a known symmetrical autogenous rotor.

FIG. 3 shows, diagrammatically, a known symmetrical autogenous rotor (29) in which the chamber members (30) are constructed to be mirror symmetrical. The chamber wall (31) is (circularly) coincident with the outer edge (32) of the rotor (29) and a radially oriented partition (33) is placed in the middle, by means of which partition the chamber member (30) is subdivided into a chamber member section oriented forwards (34) and a chamber member section oriented backwards (35), viewed in the direction of rotation (36). Just as in the case of the non-symmetrical rotor (1), here as well the direction of movement (37)(38) of the material has to be reversed. The advantage of such a symmetrical construction is that the rotor (29) can be rotated in two directions (36), as a result of which the life time, which essentially is determined by the number of tips (127), is doubled.

Figure 4:
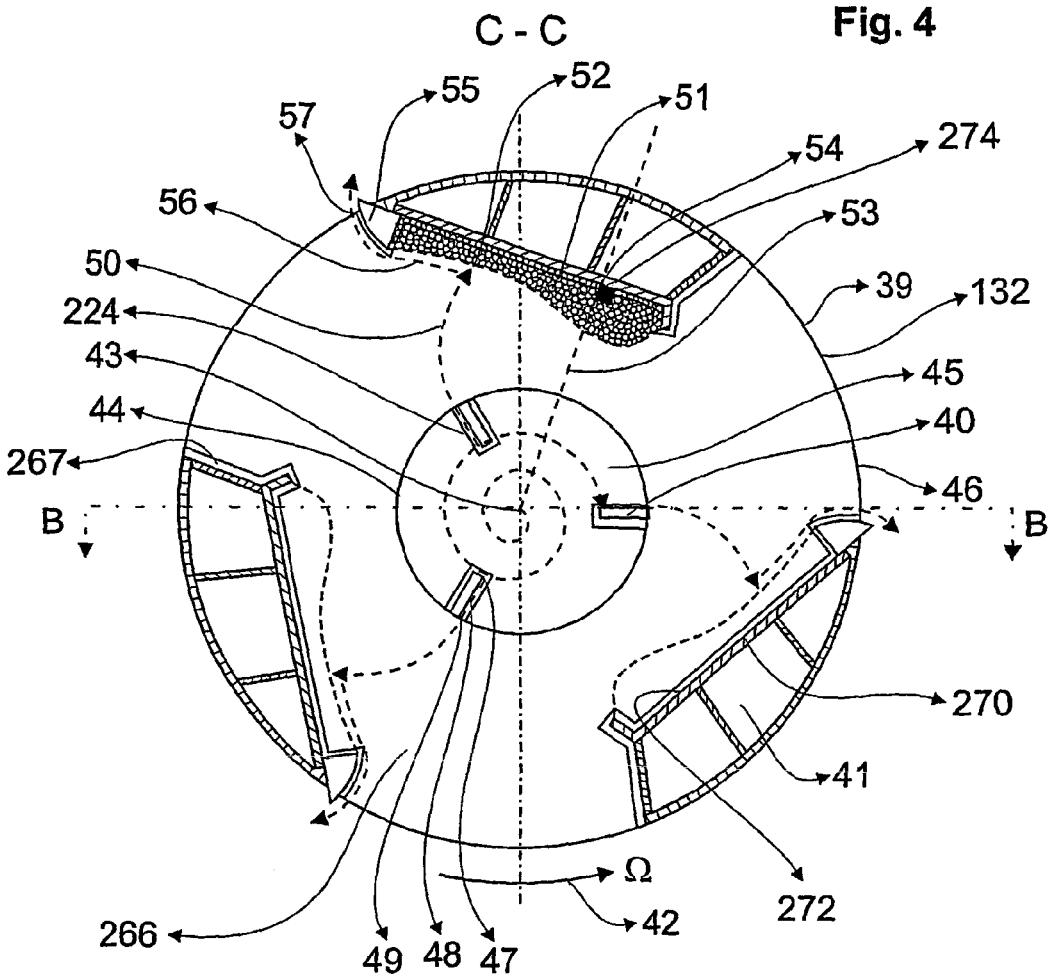
FIG. 4 shows, diagrammatically, a longitudinal section C—C of a first embodiment of a non-symmetrical rotor, according to FIG. 5.
Figure 5:
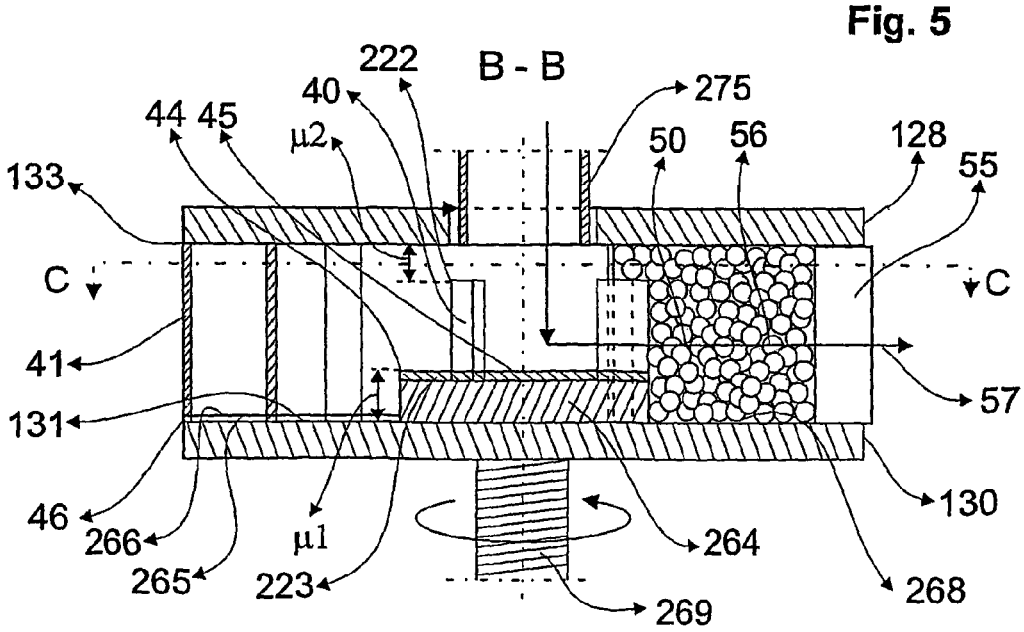
FIG. 5 shows, diagrammatically, a cross-section B—B according to FIG. 4.

FIGS. 4 and 5 show, diagrammatically, a first embodiment of a non-symmetrical autogenous rotor (39) according to the invention that can be rotated in one direction of rotation (42). The rotor (39) is provided with a central member (223) that is carried by said rotor (39), which rotor (39) is supported on a shaft (269) and is provided with an essentially circular central surface (45), the centre of which is coincident with said axis of rotation (43), and an edge member (265) that is carried by said rotor (39) and is provided with an edge surface (266) that extends between the outer edge (44) of said central member (223) and the outer edge (46) of said rotor (39). Here the central member (223) is formed by a separate central wear plate that is carried by said rotor (39) and is provided with openings (224) such that said central wear plate (223) can be pushed over the guide members (40), which central wear plate (223) can be removed as such, said rotor (39) here carrying said central member (223) with the aid of a support member (264) located between said rotor (39) and said central member (223), in such a way that said central surface (45)

is at a level above said edge surface (266). Here the edge member (265) is formed by a separate edge wear plate that is provided with openings (267) such that said edge wear plate (265) can be pushed over the chamber members (41), which edge wear plate (265) can be removed as such. The edge member or edge surface can also be formed by the top edge of the rotor blade, as is indicated as an alternative (268) in FIG. 5. It is also possible to make the rotor of stepped construction, such that the top edge of the section of said rotor that carries said central member is at a level above the top edge of the section of the rotor that carries said edge member (not indicated here). In other respects this autogenous rotor (39) is essentially identical to the known autogenous rotor (1) in FIGS. 1 and 2, with the exception that the autogenous rotor (39) according to the invention is provided with guide members (40), each of which is associated with a chamber member (41) and is carried by the rotor blades (128)(130).

The chamber member (41) is provided with at least one chamber wall (270) and at least one chamber tip (55), at least a portion (274) of the inside (272) of which chamber wall (270), which inside (272) faces the axis of rotation (43), is oriented essentially transversely to the radial plane (53) from said axis of rotation (43) and extends towards said chamber tip (55), which chamber tip (55) is at a location close to the outer edge (46) of said rotor (39), such that a continuous layer of the material is able to settle, as an autogenous chamber bed (51), on at least a portion of said inside (272) of said chamber wall (270) under the influence of centrifugal force, which autogenous chamber bed (51) extends along said inside (272) of said chamber wall (270) towards said chamber tip (55). The guide member (40) that is associated with said chamber member (41) is a smaller radial distance away from said axis of rotation (43) than is the outer edge (44) of said central surface (45) and a smaller radial distance away from said axis of rotation (43) than is said chamber member (41), which guide member (40) extends towards said outer edge (46) of said rotor (39), and is provided with at least one central feed (47), at least one guide surface (48) and at least one release end (49) for, respectively, picking up said material from said central surface (45) by said central feed (47), guiding and accelerating said picked-up material along said guide surface (48), under the influence of centrifugal force, after which said guided material leaves said guide member (40) at the location of said release end (49) and is guided into a long spiral path (50) oriented backwards, viewed in the direction of rotation (42) and viewed from a standpoint moving with said guide member (40), the position of said guide member (40) here being chosen such that said material moving along said long spiral path (50) impinges on said autogenous chamber bed (51) at an impingement location (52) that is in front of the radial line (53) from said axis of rotation (43) with said tangential location (54) thereon and a smaller radial distance away from said axis of rotation (43) than is said chamber tip (55), viewed in the direction of rotation (42). (The invention provides a possibility for arranging the impingement location behind the tangential location (54) and at the location of the tangential location (54), after which said material moves (56) from said impingement location (52) along said autogenous chamber bed (51) in the direction of said chamber tip (55), under the influence of centrifugal force, where said material is propelled outwards (57) from said rotor (39)).

As has been stated, here the outer edge (44) of the central surface (45) is located at a level above the section of the rotor, or edge surface (131), that extends between the outer edge (44) of the central surface (45) and the outer edge (46) of the rotor (39), which difference in level is indicated as the first difference in level (μ1). What is achieved by this means is that the material moves through the space between the guide member (40) and the chamber member (41), that is to say without coming into contact with the edge surface (131) there. This reduces wear and increases the (maximum) capacity, makes it possible to process coarser grains and wet (sticky) material has a lesser tendency to clog the rotor. With this arrangement it is preferable that the outer edge (44) of the central surface (45) extends to at least the release end (49). The first difference in level (μ1) must be so chosen that said material moving along the spiral path (50), when it leaves the central surface (45), moves through the space to the chamber member (41) without touching the edge surface (131) and thus no wear occurs along the edge surface. On the basis of practical experience, the first difference in level (μ1) must be at least 25 mm, but it is preferable to make this first difference in level (μ1) 50–100 mm or more.

Here the top edge (133) of the chamber member (41) is also located at a level above the top edge (222) of the guide member (40), by means of which wear is limited and the throughput improved. On the basis of practical experience, this second difference in level (μ2) must be 25–50 mm.

Figure 6:
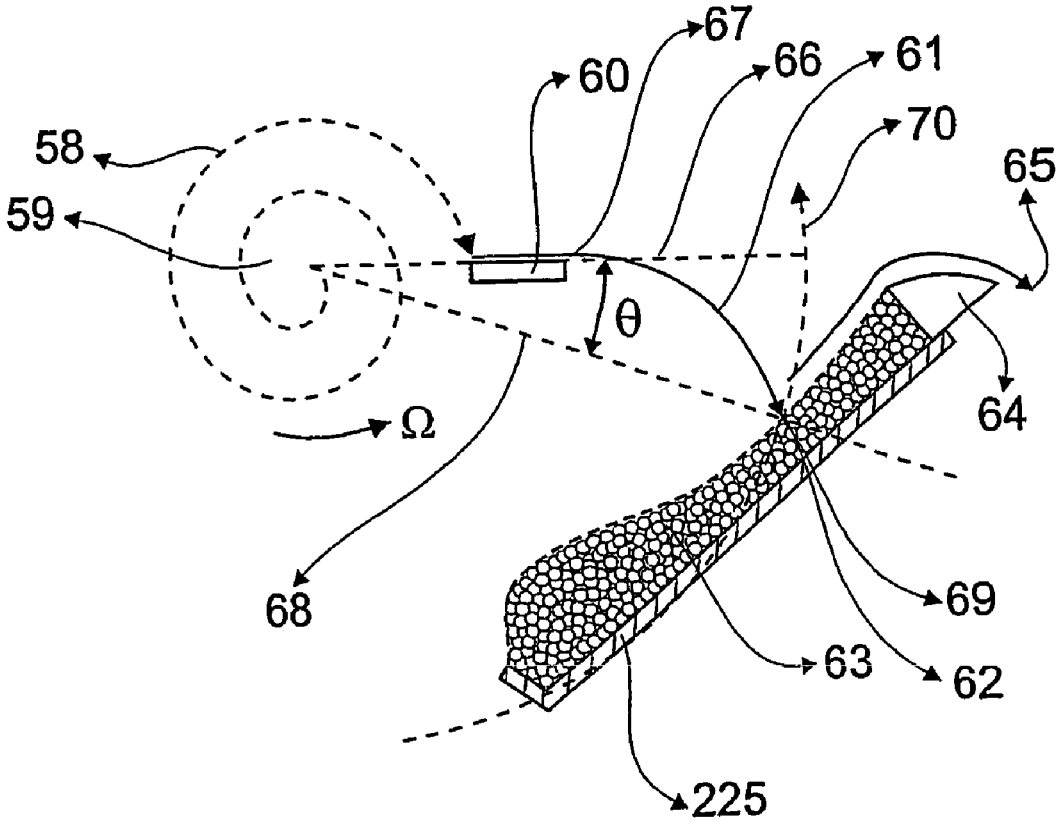
FIG. 6 shows, diagrammatically, the short and long spiral movement according to FIG. 1.

As is indicated diagrammatically in FIG. 6, the short spiral (58) along which the material on the central surface (59) moves outwards is substantially modified with the aid of the guide member (60). The short spiral (58) on the central surface (59) is converted into a long spiral (61) with the aid of the guide member (60). Thus, the long spiral (61) is much wider than the short spiral (58), the material moves in a highly concentrated manner along the long spiral (61), whilst the position of the long spiral (61) is invariant, or independent of the rotational velocity (Ω) of the rotor. This is in contrast to the short spiral (58), the position of which is determined by the rotational velocity (Ω).

Because the stream (61) of material now moves in a controlled manner (that is to say deterministically instead of chaotically) and has to be reversed (62) to a lesser extent, the flow proceeds much better, as a result of which there is a saving in energy and less wear, whilst the capacity increases (substantially); furthermore, wetter (sticky) and coarser material can be processed. But it is certainly equally important that the material moving along the long spiral (61) impinges in a concentrated manner and at high velocity on the autogenous chamber bed (63), the collision velocity being determined by the rotational velocity (Ω) of the rotor. A fairly high comminution intensity is generated by this impact. The material then moves under the influence of centrifugal force along the autogenous chamber bed (63) in the direction of the chamber tip (64), from where it is propelled outwards (65) from the rotor.

The position of the guide member (60) is determined by the angle (θ) between the radial line (66) with the release end (67) thereon and the radial line (68) with, thereon, the location where the spiral path (61) and the path (70) which the chamber member (225) describes intersect one another, which angle is to be so chosen that the arrival of said material moving along the spiral path (61) at the location (impingement location) (69) where the paths (61)(70) intersect one another is synchronised with the arrival of the chamber member (225) at this location.

The synchronisation angle (θ), and thus the invariant position of the long spiral (61), is highly influenced by the positioning of the guide member (60), which can be oriented backwards (radially here), radially and forwards.

Figure 7:
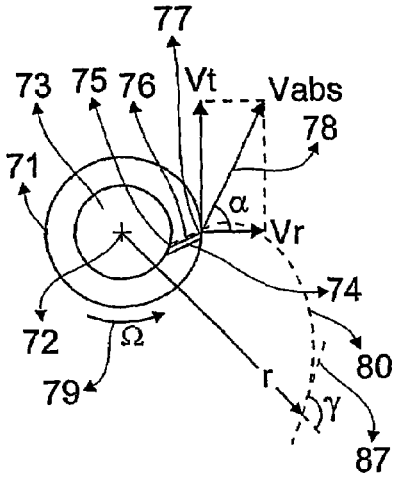
FIG. 7 shows a first diagrammatic rotor with velocity components.

FIG. 7 shows a first diagrammatic rotor (71) which rotates at a rotational velocity (Ω) about a central axis of rotation (72), which rotor is provided with a central surface (73), which acts as metering location, and a guide member (74) that is provided with a central feed (75), a guide surface (76) and a release end (77). The material is picked up by the central feed (75) and then accelerated, under the influence of centrifugal force, along the guide surface (76), which is oriented forwards viewed in the direction of rotation (79), the material building up a radial (Vr) ad a traverse (Vt) velocity component. The accelerated material is then propelled outwards from said release end (77) at an absolute take-off velocity (Vabs) along a straight path (78) that is oriented forwards, viewed in the direction of rotation (79) and viewed from a stationary standpoint. The absolute take-off velocity (Vabs) and the absolute take-off angle (α) are determined by the magnitudes of the radial (Vr) and transverse (Vt) velocity components. Viewed from a standpoint moving with the guide member (74), after the material leaves the guide member (74) it moves in a spiral path (80) directed backwards and—in the relative sense—is accelerated along this path.

Figure 8:
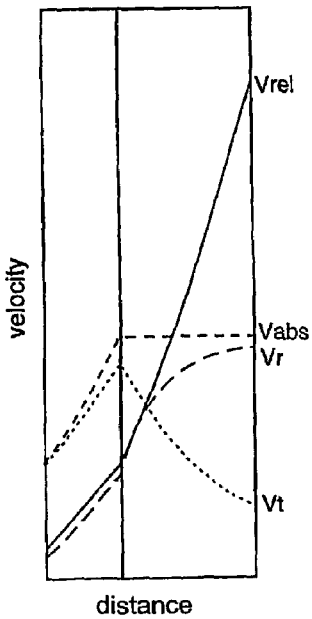
FIG. 8 shows the development of the velocity components according to FIG. 7.

FIG. 8 shows, for FIG. 7, the change (development) in the radial (Vr) and transverse (Vt) velocity components and the absolute velocity (Vabs) and relative velocity (Vrel) of the material when it moves along the guide surface (76) and then is propelled outwards from said release end (77). At the take-off location (77) the radial (Vr) velocity component is (much) smaller than the transverse (Vt) velocity component, with the result that the take-off angle (α) is more than 45° (if the transverse (Vt) and radial (Vr) velocity components are identical the take-off angle (α) is 45°). From the take-off location (77) the material moves at a constant take-off velocity (Vabs) along said straight path (78); the radial (Vr) velocity component increasing and the transverse (Vt) velocity component decreasing as the material moves farther away from the axis of rotation (O).

At the point in time when the material leaves the guide member (74) the relative velocity (Vrel) is (much) lower than the absolute velocity (Vabs); nevertheless the relative velocity (Vrel) then increases substantially when the material moves along the spiral path (80), whilst the absolute velocity (Vabs) of the material moving along the straight path (78) remains constant.

Figure 9:
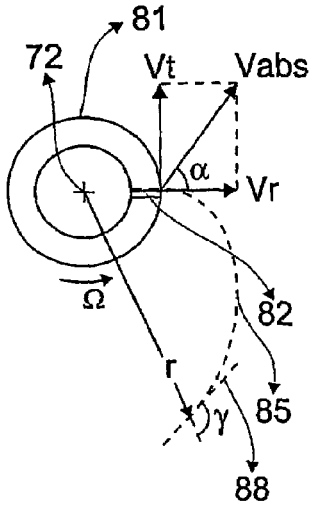
FIG. 9 shows a second diagrammatic rotor with velocity components.
Figure 10:
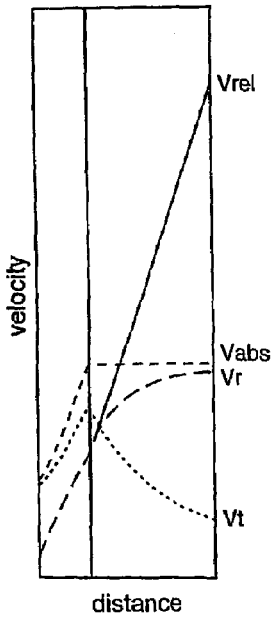
FIG. 10 shows the development of the velocity components according to FIG. 9.

FIGS. 9 and 10 describe a second diagrammatic rotor (81), similar to the rotor (71) in FIGS. 7 and 8, where the guide surface (82) is oriented radially. As a result of orienting the guide surface (82) radially the transverse (Vt) velocity component decreases and the radial (Vr) velocity component increases (compared with a guide surface (76) oriented forwards (FIGS. 7 and 8), with the consequence that the absolute take-off angle (α) is approximately 45°, whilst the take-off velocity (Vabs) decreases, compared with a radial arrangement. The relative velocity (Vrel) consequently also increases at the point in time when the material leaves the guide member, and then increases less rapidly along the spiral than in the case of a guide surface oriented radially.

Figure 11:
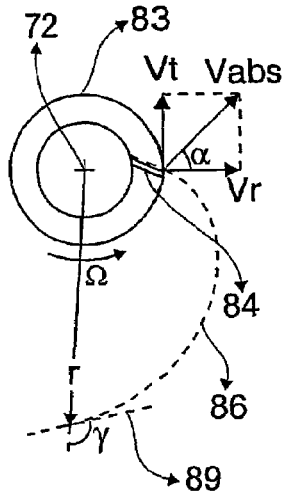
FIG. 11 shows a third diagrammatic rotor with velocity components.
Figure 12:
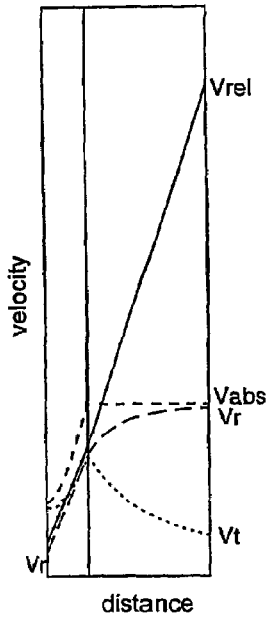
FIG. 12 shows the development of the velocity components according to FIG. 11.

FIGS. 11 and 12 describe a third diagrammatic rotor (83) similar to the rotor (71) in FIGS. 7 and 8, where the guide surface (84) is oriented obliquely backwards, viewed in the direction of rotation (85). The radial (Vr) velocity component predominates, as a result of which the absolute take-off angle (α) decreases and is less than 45°, whilst the take-off velocity (Vabs) decreases, compared with a radial arrangement. The relative take-off velocity (Vrel) increases somewhat (compared with a guide member (82) oriented radially) and then increases somewhat less rapidly.

It is thus possible substantially to influence the take-off angle (α) and the take-off velocity (Vabs) with the aid of the positioning of the guide member. The greater the extent to which the guide surface is oriented forwards (76), the more the absolute take-off velocity (Vabs) decreases and the more the absolute take-off angle (α) decreases. The greater the extent to which the guide surface is oriented more towards the rear (84), the more the absolute take-off angle (α) increases and the more the absolute take-off velocity (Vabs) increases. In the relative sense, the relative take-off velocity (Vrel) increases the greater the extent to which the guide surface (76)(82)(84) is oriented more towards the rear, whilst the acceleration along the spiral path decreases somewhat. It is very important that the length of the long spiral path, required in order to reach a point a radial distance (r) away from said axis of rotation, increases (80)(85)(86) the greater the extent to which the guide surface is arranged more towards the rear (76)(82)(84), as a result of which the radiality also increases (<γ). This radiality is defined as the angle between the radial line (r) from said axis of rotation (72) with the location thereon where the long spiral path (80)(85)(86) is located a radial distance (r) away from said axis of rotation (72), and the tangent (87)(88)(89) along said long spiral path (80)(85)(86) at the location along said spiral path (80)(85)(86) which is located a radial distance (r) away from said axis of rotation (72).

Figure 13:
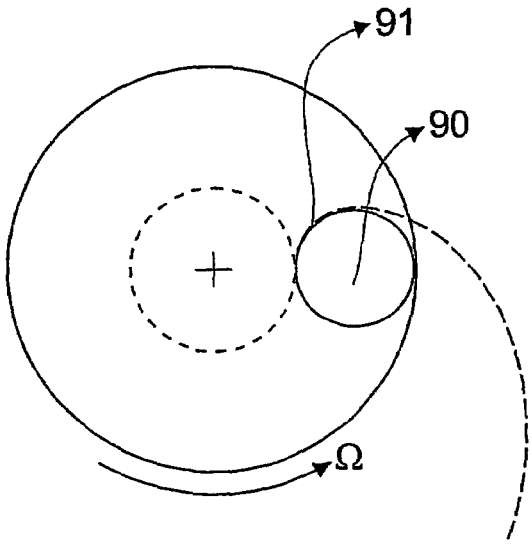
FIG. 13 shows a fourth diagrammatic rotor.
Figure 14:
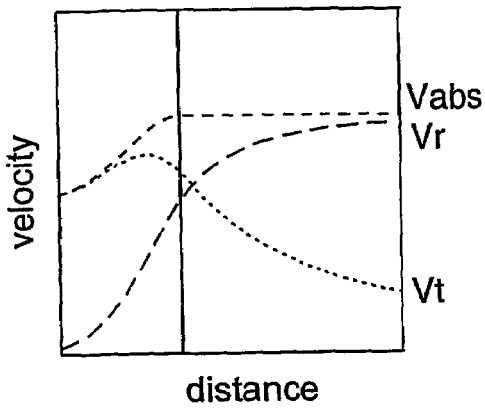
FIG. 14 shows the development of the velocity components according to FIG. 13.
Figure 15:
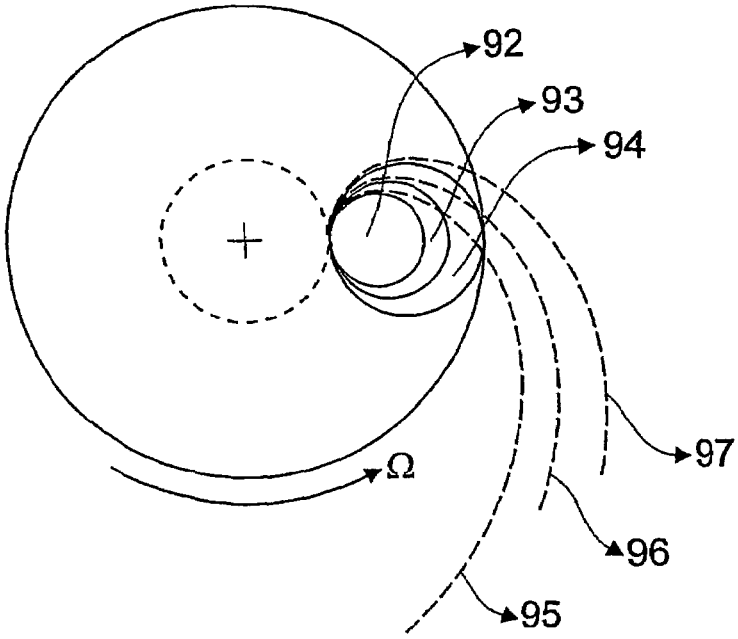
FIG. 15 shows the fourth diagrammatic rotor from FIG. 13 with various cylinder diameters.
Figure 16:
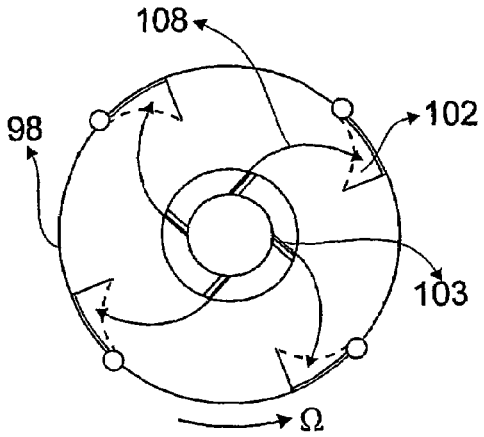
FIG. 16 shows, diagrammatically, a rotor with guide members oriented backwards.
Figure 17:
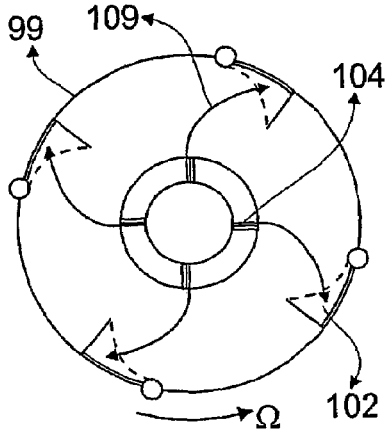
FIG. 17 shows, diagrammatically, a rotor with radially oriented guide members.
Figure 18:
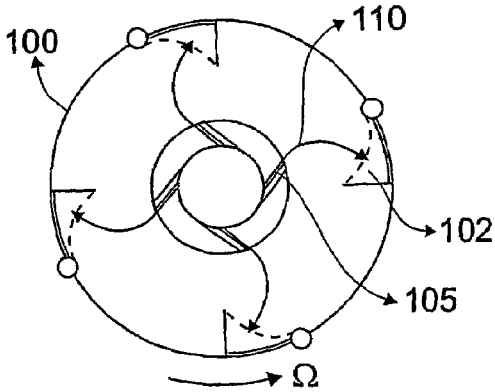
FIG. 18 shows, diagrammatically, a rotor with guide members oriented forwards.

As is indicated diagrammatically in FIGS. 13 and 14, the accelerator member (90) can also be of cylindrical construction, in which case there is a curved guide surface (91) directed forwards, which also has the advantage that it is symmetrical. As is indicated in FIG. 15, the cylindrical shape also has the advantage that the position of said long spiral path (95)(96)(97) can be accurately determined or moved by changing the diameter of the accelerator cylinder (92)(93)(94); said spiral path being moved outwards as the diameter of the accelerator cylinder (92)(93)(94) increases.

Figure 19:
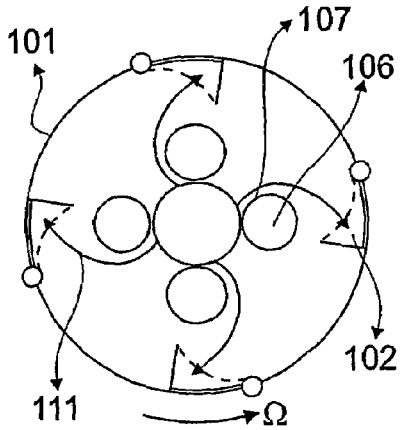
FIG. 19 shows, diagrammatically, a rotor with cylindrical guide members.

FIGS. 16 to 19 now show, diagrammatically, four essentially identical rotors (98)(99)(100)(101) which can be rotated in one direction and are each equipped with four chamber members (102) but with different guide members, that is to say with, respectively, guide surfaces directed backwards (103) (FIG. 16), guide surfaces oriented radially (104) (FIG. 17), guide surfaces directed forwards (105) (FIG. 18) and cylindrical (106) guide surfaces FIG. 19), the latter (106) representing guide surfaces (107) that are essentially curved forwards. The long spiral paths (108)(109)(110)(111) which the material streams describe after they leave the respective guide surfaces differ substantially (as described in FIGS. 7 to 15). Thus, the length of the long spiral path decreases the greater the extent to which the guide surface is directed forwards, whilst the relative impact velocity at the same radial distance (r) from the axis of rotation does not differ greatly. Here a short spiral path has the advantage that the radiality a specific distance away from the axis of rotation is smaller (>γ), compared with a longer spiral path. As a result, the impact with the autogenous chamber bed takes place at a more closed (or more perpendicular) angle, what is achieved by this being that the impact results in a higher intensity of comminution, whilst the material stream has to reverse to a lesser extent in order to be guided along the autogenous chamber bed towards the chamber tip. This, however, is onset by the fact that the material is picked up much more easily (more naturally) from the central surface by a guide member directed backwards, as a result of which there is a saving in energy and a reduction in wear, and a higher capacity can be achieved. A cylindrical (at least semi-cylindrical) guide member which as well as possible combines the advantages of guide members directed forwards and glide members directed backwards and also makes a symmetrical construction possible provides a compromise.

Figure 20:
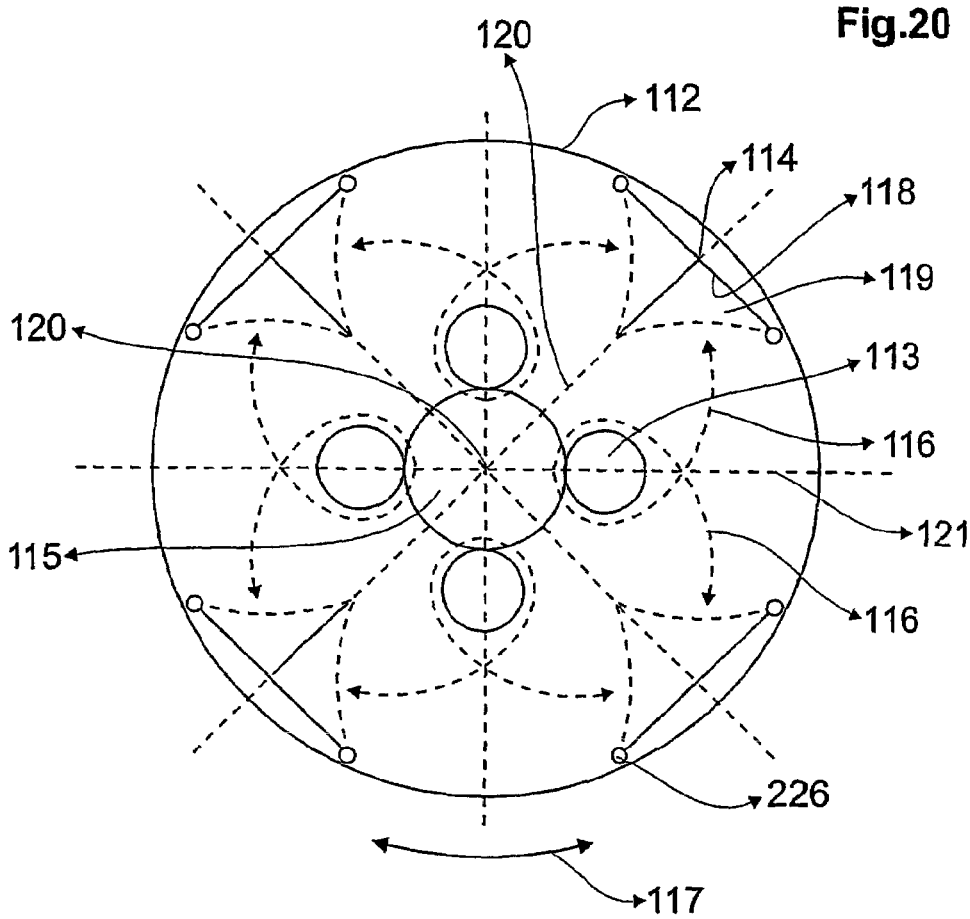
FIG. 20 shows, diagrammatically, a first embodiment of a symmetrical rotor.

FIG. 20 shows, diagrammatically, a first embodiment of a symmetrical rotor (112) according to the invention that is constructed with four cylindrical guide members (113) and four symmetrical chamber members (114) associated therewith. The material that is metered onto the central surface (115) with the aid of a metering member (not shown here) is picked up by the cylindrical guide members (113) and brought into a long spiral movement (116), depending on the direction of rotation (117), towards the symmetrical chamber member (114) in which an autogenous chamber bed (119) builds up in contact with the chamber wall (118). The guide members (113) are symmetrical along a first radial plane of symmetry (121) that is coincident with the radial plane of symmetry. The chamber members (114) are symmetrical along a second radial plane of symmetry (120) that is coincident with the radial plane of symmetry. In this way the rotor (112) according to the invention can be equipped very easily with four symmetrical chamber members (114), what is achieved by this means being that, in addition to a high intensity of comminution, the life time is long as a result of the eight chamber tips (226), whilst a fairly high capacity is achievable as a result of the large free space for passage in the rotor (112).

Figure 21:
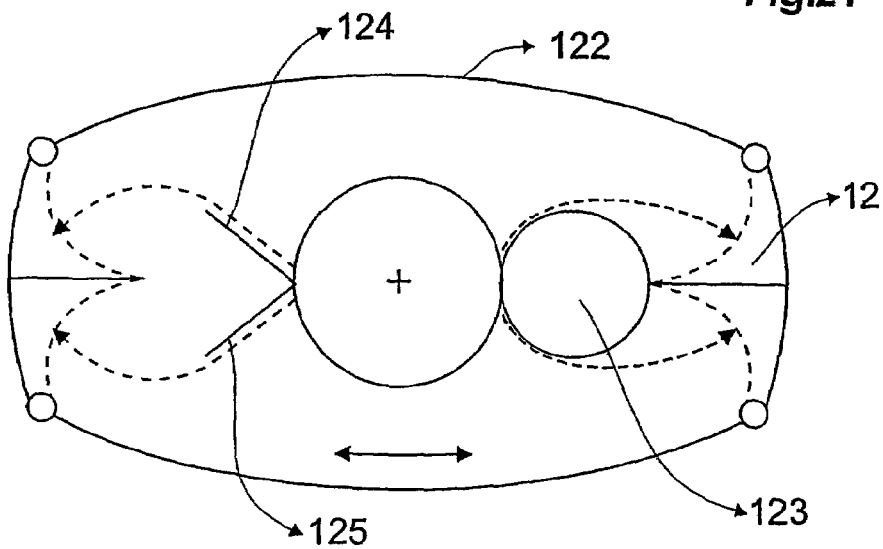
FIG. 21 shows, diagrammatically, a second embodiment of a symmetrical rotor.

FIG. 21 shows, diagrammatically, a second embodiment of a symmetrical rotor (122) according to the invention, essentially identical to the symmetrical autogenous rotor (112) in FIG. 20, but equipped with two symmetrical chamber members (12). It is indicated that instead of a cylindrical guide member (123) it is also possible to orient the symmetrical guide member (124)(125) straight forwards.

It is clear that both in the non-symmetrical and in the symmetrical embodiment many configurations of guide members and associated chamber members are conceivable in the spirit of the invention.

Figure 22:
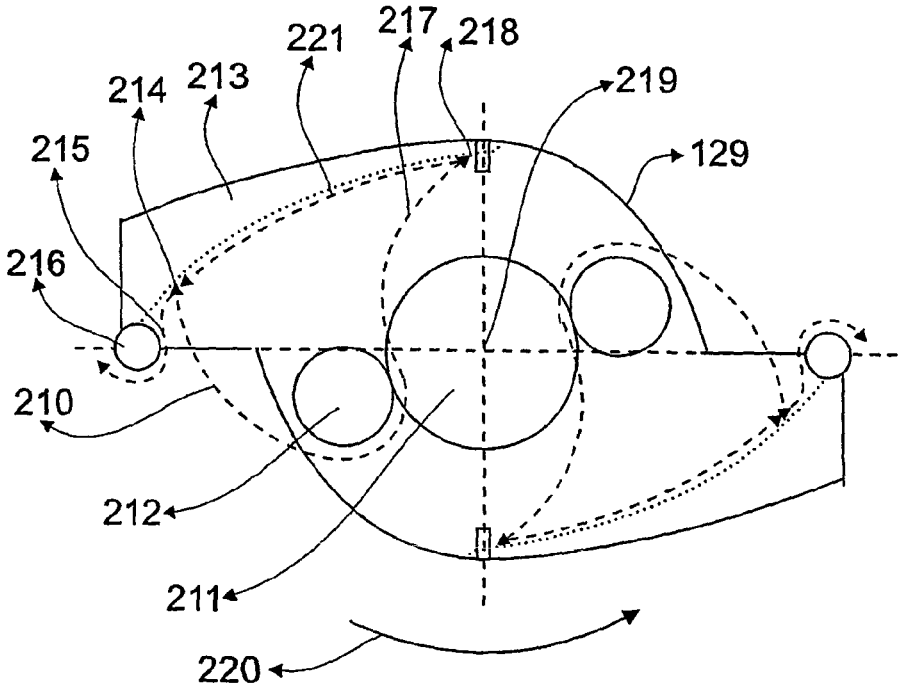
FIG. 22 shows, diagrammatically, a second embodiment of a non-symmetrical rotor.

FIG. 22 shows, diagrammatically, a second embodiment of a non-symmetrical rotor (129) according to the invention, essentially identical to the rotor (122) in FIG. 21, but the peripheral shape forms a mirror image here, by which means it is indicated that many configurations of non-symmetrical rotors are conceivable within the invention. In this rotor (129) a first portion (210) of the material metered onto the central surface (211) is fed with the aid of the guide member (212) to the autogenous chamber bed (213) at an impingement location (214), from where said material moves in the direction (215) of the chamber tip (216), whilst a second portion (217) of the material is picked up in an as it were natural manner by the autogenous chamber bed (213) at a feed location (218) that is located behind the radial line from said axis of rotation (219) which has said impingement location (214) thereon, sewed in the direction of rotation (220). This second portion (217) of the material moves (221) along the autogenous chamber bed (213) in the direction of the chamber tip (216), under the influence of centrifugal force, said second portion (221) passing the impingement location (214) where it is struck intensively by the impinging first portion (210) of the material. Because the autogenous chamber bed (213) is continually refreshed by the second portion (217)(221) of the material, the impact of the first portion (210) of the material on the second portion (221) of the material at said impingement location (214) results in a high intensity of comminution.

Figure 23:
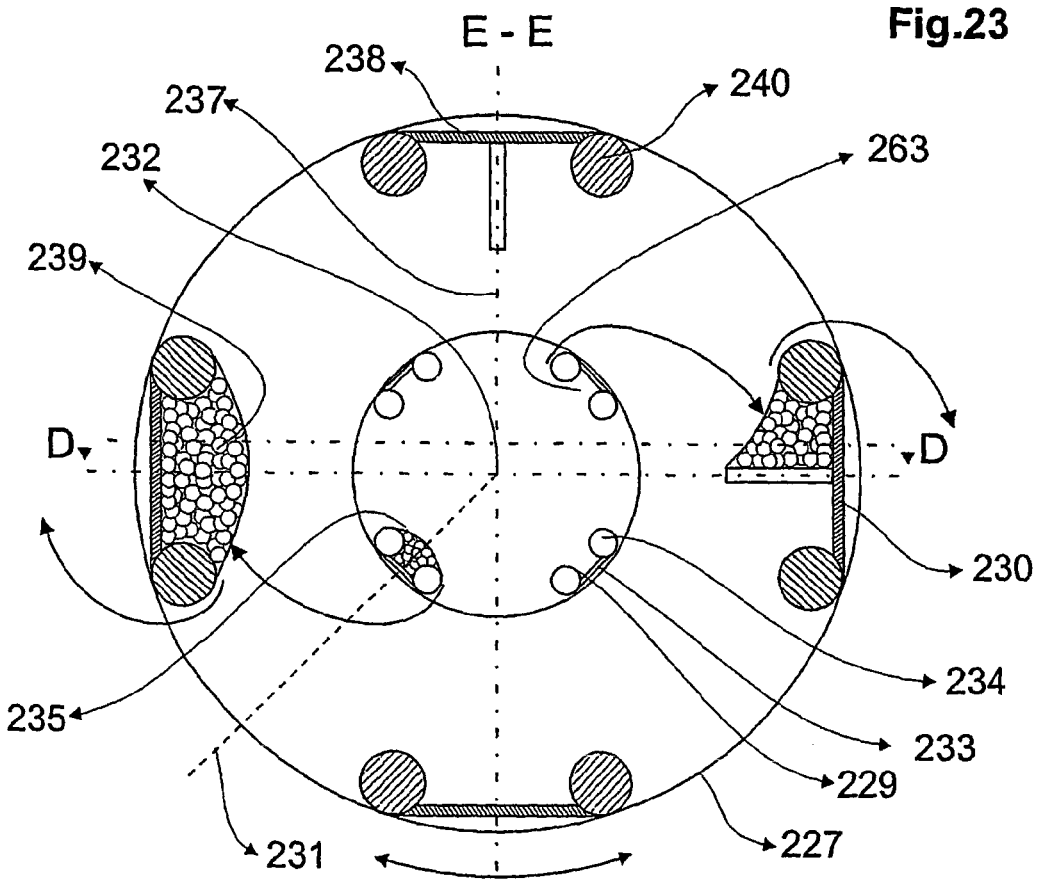
FIG. 23 shows, diagrammatically, a longitudinal section E—E of a third embodiment of a symmetrical rotor, according to FIG. 24.
Figure 24:
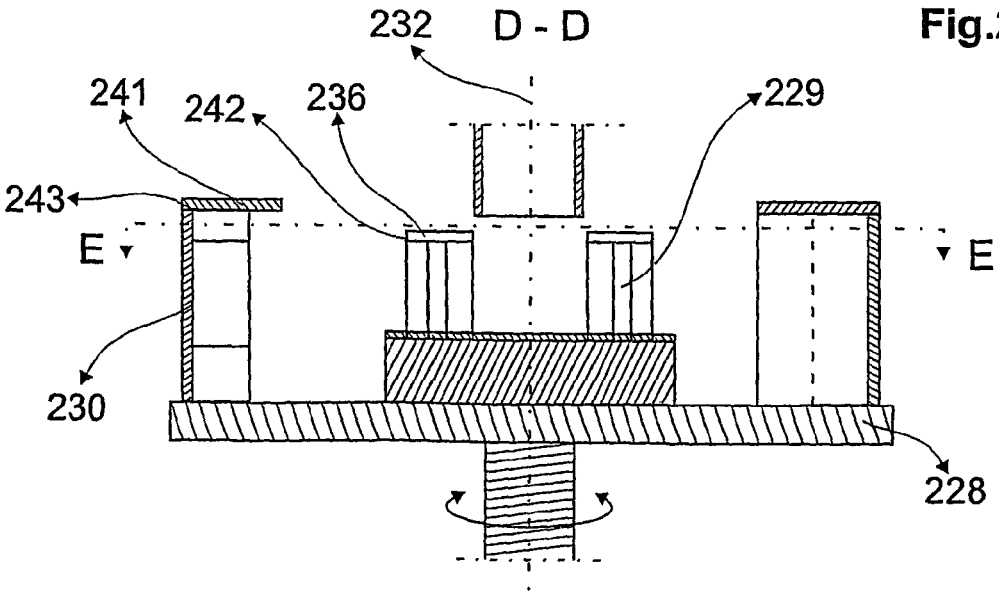
FIG. 24 shows, diagrammatically, a cross-section D—D according to FIG. 23.

FIGS. 23 and 24 show, diagrammatically, a third embodiment of a symmetrical autogenous rotor (227) that is of open construction (one rotor blade (228)), and where the guide members (229) are arranged at a higher level than the chamber members (230). The guide members (229) are of mirror symmetrical construction with respect to a second radial plane of symmetry (231) from said axis of rotation (232), each of which guide member (229) is constructed as a guide chamber (263), the inside of the chamber wall (233) of which guide chamber (263) is oriented perpendicularly to said second radial plane of symmetry (231) where said inside of the chamber wall (233) intersects the second radial plane of symmetry (231). The guide tips (234) are of essentially cylindrical construction, such that an autogenous guide bed (235) is able to settle between the guide tips (234) in the guide chamber (263), which cylinders (234) have a diameter of at least 25 mm and at most 125 mm. Instead of being made in a cylindrical shape, the guide tips (234) can also be made in a different shape, for example semi cylindrical or (semi-)elliptical, and it is, of course, also possible to construct these as partially angular.

The chamber members (230) are of mirror symmetrical construction with respect to a first radial plane of symmetry (237) from the axis of rotation (232), the chamber wall (238) being oriented perpendicularly to said first radial plane of symmetry (237) where this chamber wall (238) intersects the first radial plane of symmetry (237). The chamber tips (240) are of cylindrical construction, such that an autogenous chamber bed (239) is able to settle between said cylindrical chamber tips (240), which cylinders (240) have a diameter of at least 50 mm and at most 150 mm. Instead of being made in a cylindrical shape, the chamber tips (240) can also be made in a different shape, for example semi-cylindrical or (semi-) elliptical, and it is, of course, also possible to make these of partially angular construction.

Here the guide member (229) and the chamber member (230) are provided with a cover plate (236)(241) which extends from the top edge (242)(243) of said guide member (229) and the chamber member (230) towards said axis of rotation (232).

Figure 25:
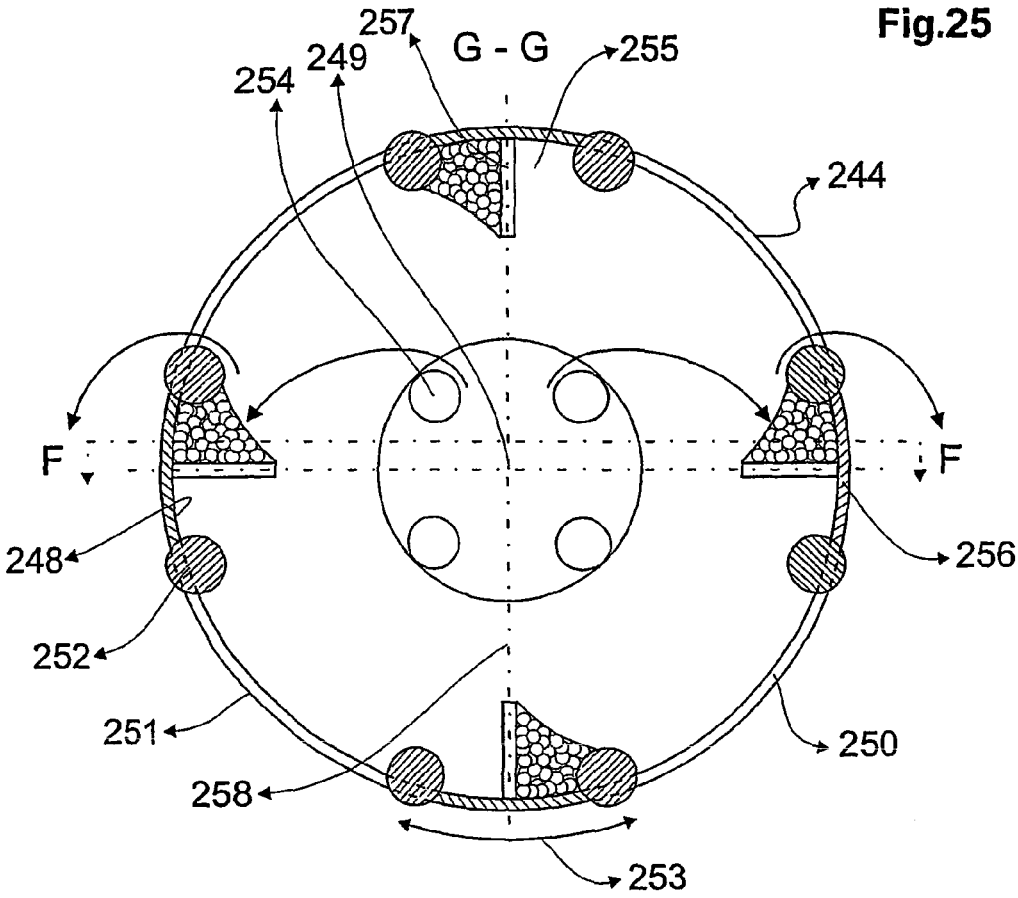
FIG. 25 shows, diagrammatically, a longitudinal section G—G of a fourth embodiment of a symmetrical rotor, according to FIG. 26.
Figure 26:
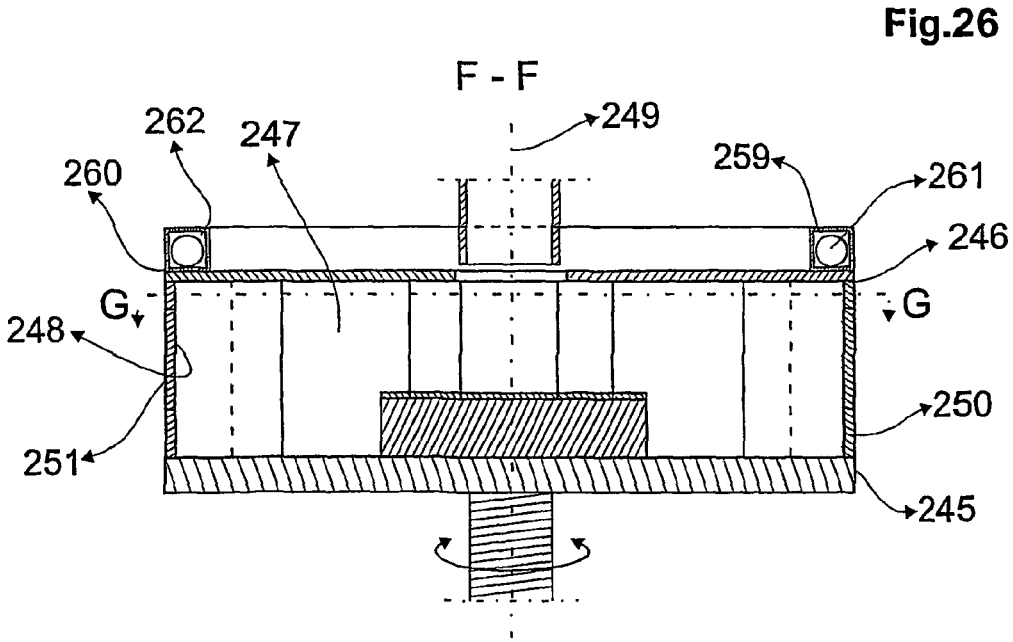
FIG. 26 shows, diagrammatically, a cross-section F—F according to FIG. 25.

FIGS. 25 and 26 show a fourth embodiment of a symmetrical autogenous rotor (244) that is of closed construction (two rotor blades (245)(246) as a sandwich) in the form of an autogenous drum (247), the inside (248) of the drum (247) describing a surface of revolution the axis of revolution of which is coincident with the axis of rotation (249), ejection openings (251) being made in he wall (250) of the drum (247), which ejection openings (251) are at a location in front of and alongside the chamber tips (252), viewed in the direction of rotation (253). Here the surface of revolution describes a cylindrical shape. The guide members (254) are arranged at a higher level and here are of symmetrical (cylindrical) construction. The chamber members (255) are of symmetrical construction and consist of a chamber wall (256) that is formed by part of the cylindrical drum wall (250) between two cylindrical chamber tips (252). The chamber member (255) is provided with a partition surface (257) that extends from the chamber wall (256) along a first radial plane of symmetry (258) towards the axis of rotation (249). The rotor (244) is also provided with a balancing ring (259) which here is constructed as a square tube which extends along the edge (260) on top of the rotor (244). The balancing ring (259) is at least 75% filled with oil (262) and contains at least three steel balls (261). Instead of balls (261) it is also possible to use flat, circular discs (not indicated here). The balancing ring (259) can also be arranged in a different location on the rotor (244). It is clear that the other rotor designs that have been discussed can also be provided with such a balancing ring (259).

Figure 27:
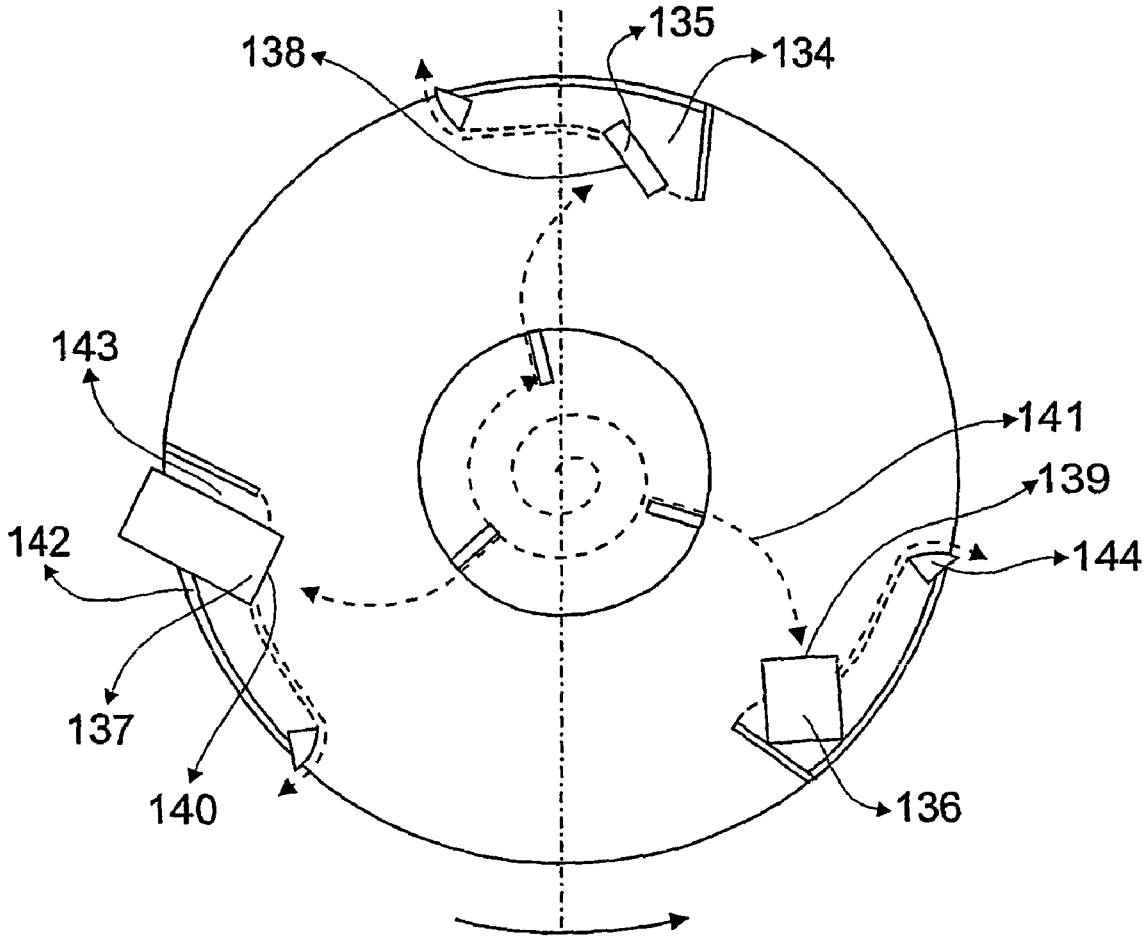
FIG. 27 shows, diagrammatically, a third embodiment of a non-symmetrical rotor with various impact members.

FIG. 27 shows, diagrammatically, a third embodiment of a non-symmetrical rotor according to the invention, wherein the chamber members (134) are provided with an impact member that is arranged, respectively, in the form of an impact plate (135), an enclosed impact block (136) and an impact surface (137) continuing through. Such an impact member appreciably increases the intensity of comminution during the impact, it being possible so to arrange the impact member that some of the material impinges on the impact surface (138)(139)(140) and some of the material impinges on own material that is located in front of and, respectively, alongside the impact surface. By this means a sort of hybrid action is generated, by means of which a reasonable intensity of comminution is achieved, whilst wear remains limited. The impact block (136) can also be curved in the longitudinal direction (not shown here) located in the extension of the spiral path (141). The rear of the impact surface (137) can also protrude through the chamber wall (142) of the chamber member (143), what is achieved by this means being that the impact block is able to wear through without the chamber wall (142) and the mounting construction for the impact block being damaged. After the material has impinged on the impact surface (138)(139)(140), it moves along the autogenous chamber bed (134) in the direction of the chamber tip (144) and is propelled outwards from there.

Figure 28:
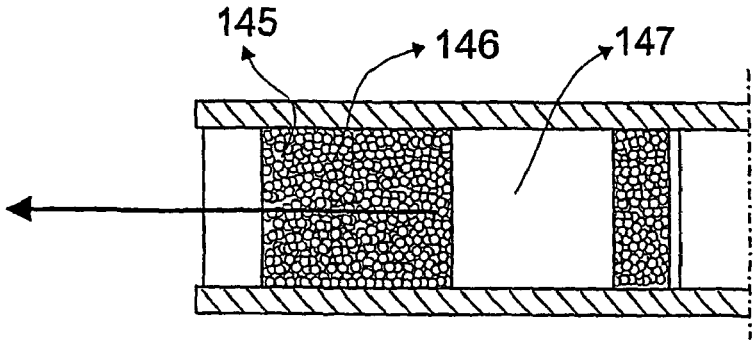
FIG. 28 shows a first front view of a chamber member.
Figure 29:
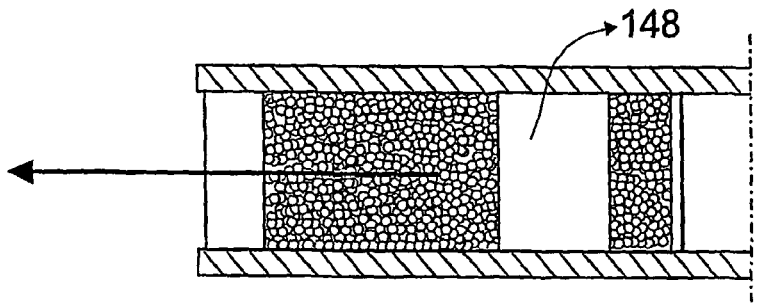
FIG. 29 shows a second front view of a chamber member.
Figure 30:
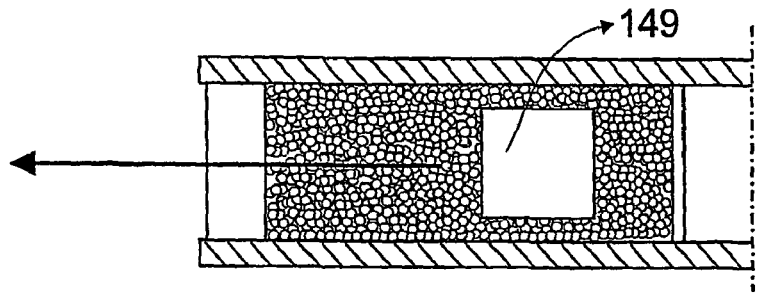
FIG. 30 shows a third front view of a chamber member.
Figure 31:
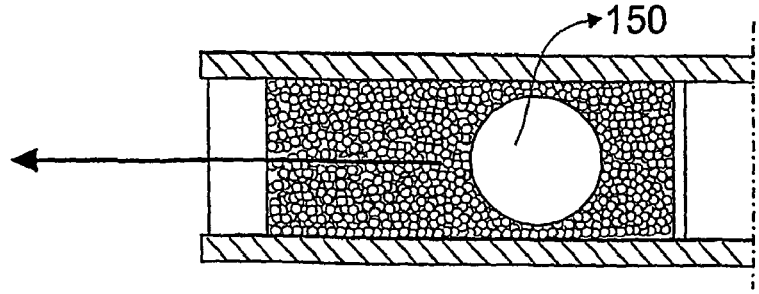
FIG. 31 shows a fourth front view of a chamber member.

FIG. 28 shows a first front view of a chamber member (145) in which the autogenous chamber bed (146) and the impact surface (147) of the impact member are visible. In this case the impact surface (147) is of square construction, but as is indicated in FIG. 29 this can also be of rectangular (148) construction. With this arrangement the peripheral shape of the impact surface usually determines the peripheral shape of the impact member. As is shown in FIGS. 30 and 31, it is also possible to make the impact surface square (149) or cylindrical (150) (or some other shape) such that it is surrounded on all sides by autogenous chamber bed material.

Figure 32:
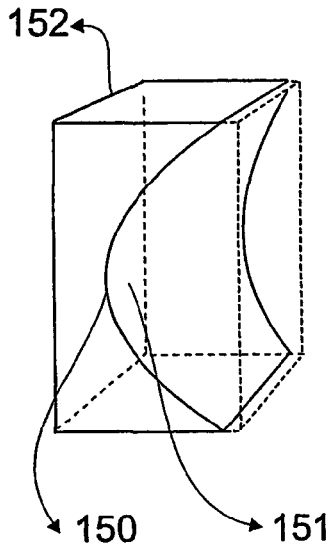
FIG. 32 shows a wear pattern such as develops along the release end.

FIG. 32 shows a wear pattern (150) such as develops along the release end (151) of said chamber tip (152) that is homogeneously composed of hard material, optionally a composition. As the wear increases, this concentrates more towards the centre of the chamber tip (152), the wear increasing in the direction of the release end (151). One problem with such a wear pattern (150) is that the stream of material starts to concentrate in the centre of the chamber tip (152), as a result of which the wear also concentrates in this location to an ever increasing extent, as a result of which wear starts to proceed ever (progressively) more rapidly here. Moreover, a concentration of the stream of material along the guide surface is the cause of the capacity of the guide member decreasing.

Figure 33:
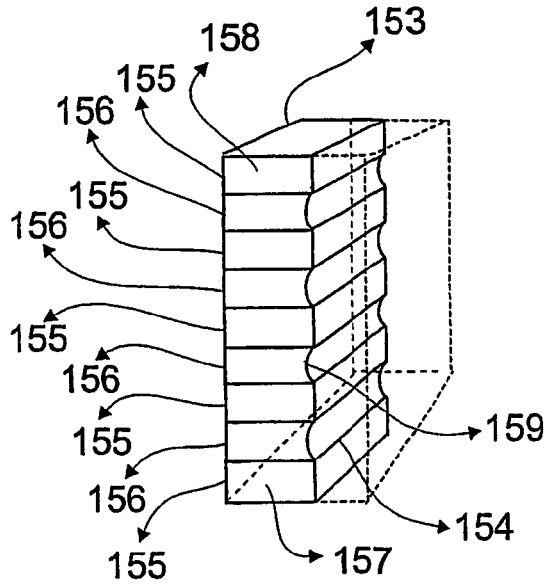
FIG. 33 shows, diagrammatically, a chamber tip with a release end of a layered construction.

FIG. 33 shows, diagrammatically, a chamber tip (153) with a release end (154) having a layered construction, layers of higher resistance to wear (155) and of lower resistance to wear (156) being stacked alternately on top of one another in the vertical direction; such a construction must be made up of at least three, but preferably at least five, layers with the bottom (157) and the top (158) layer composed of material having a high resistance to wear. Wear concentrates along the layers (156) of lower resistance to wear, as a result of which multiple guide channels (159) form, along which the stream of material is guided outwards and concentration is prevented, and the material is distributed as it were in the vertical direction over the release end (154).

Figure 34:
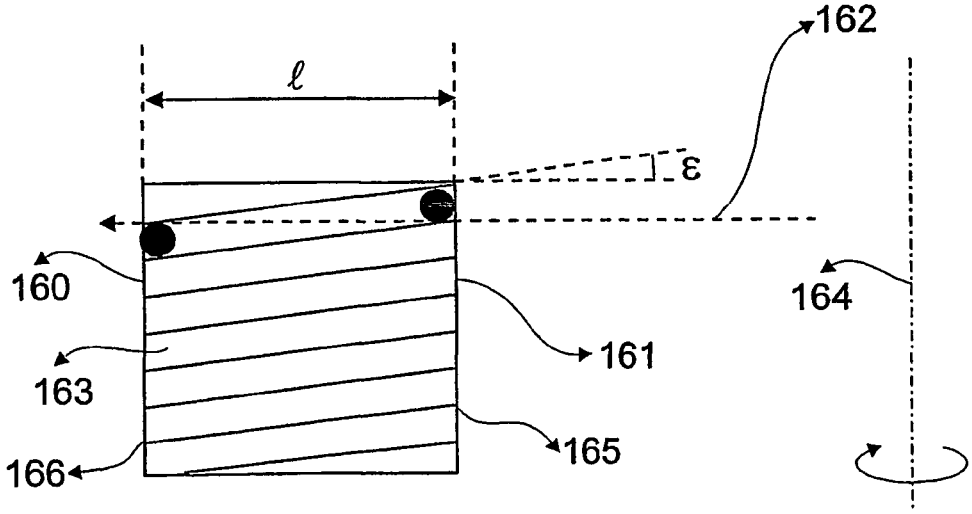
FIG. 34 shows, diagrammatically, a chamber tip with a release end having an inclined layered construction.

FIG. 34 shows a chamber tip (160) having a layered construction as essentially described in FIG. 33, the layers (161) being arranged in the vertical direction parallel to one another at a somewhat inclined angle (ϵ). This has the advantage that the material becomes distributed in the vertical direction and moves outwards under the influence of centrifugal force in virtually the direction of the plane of rotation (162) over the release end (163) and essentially no guide channels (159) (FIG. 33) are able to form, as a result of which the wear develops in the vertical direction regularly over the release end (163) and concentration towards the centre is avoided. With this arrangement it is preferable to orient the angle (ϵ) at which the layers (161) are arranged somewhat downwards in the outward direction, viewed from the axis of rotation (164), the start points (165) of the respective layers (161) along the release end (163) being brought downwards at least one third but preferably one grain diameter towards the end point (166). The angle (ϵ) at which the layers (161) have to be arranged for this essentially satisfies the equation:

$$\varepsilon = \arctan\frac{D'}{l_g}$$

where:

ϵ=the angle at which the layers (161) of a chamber tip stacked on top of one another are arranged with respect to the plane of rotation D'=the diameter of the granular material $l_g$=the minimum length of the release end (163)

Figure 35:
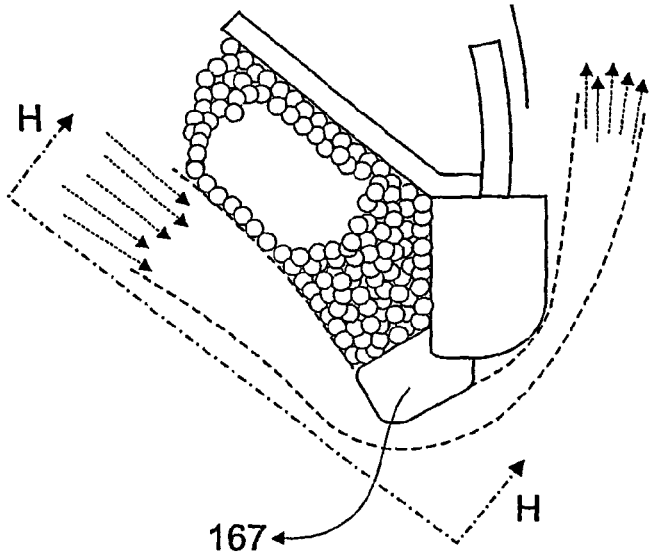
FIG. 35 shows, diagrammatically, a first embodiment of a chamber tip.
Figure 36:
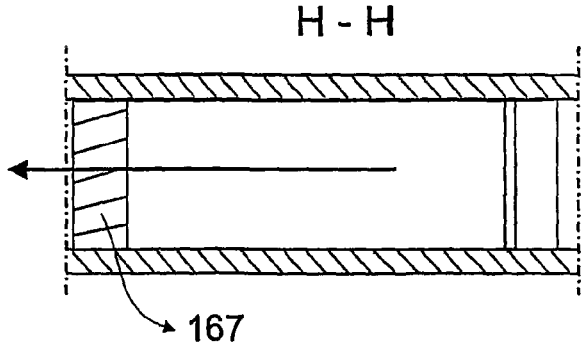
FIG. 36 shows, diagrammatically, a cross-section H-H according to FIG. 35.
Figure 37:
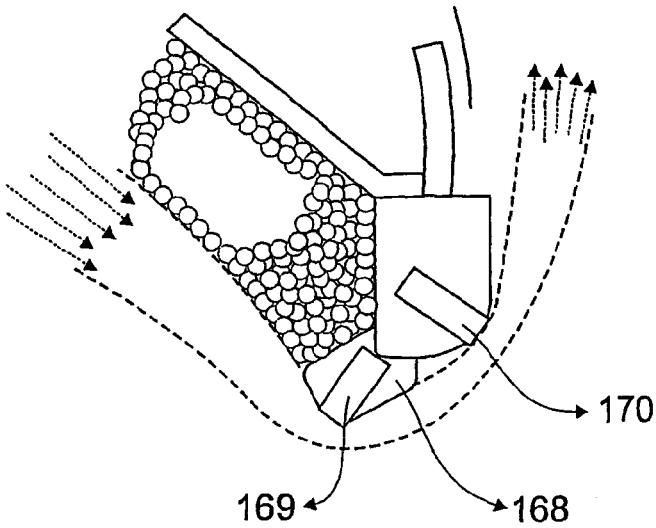
FIG. 37 shows, diagrammatically, a second embodiment of a chamber tip.

A chamber tip (167) that is constructed with such an inclined layered construction is indicated diagrammatically in FIGS. 35 and 36. As is indicated in FIG. 35, the chamber tip (167) can also be constructed in parts, it being possible for both or one of the parts to be constructed with an inclined layered construction. As is indicated in FIG. 37, it is also possible for a part (169)(170) of the chamber tip (168) in the vertical direction to be constructed with an insert (169)(170), which insert (169)(170) has an inclined layered construction. What is achieved by constructing the chamber tip (167)(168), or at least part of the chamber tip (167)(168), with such a layered construction is that wear takes place uniformly over the chamber tip (167)(168). The life time of the chamber tip (167)(168) is thus appreciably extended and the chamber tip has to be replaced less frequently.

Figure 38:
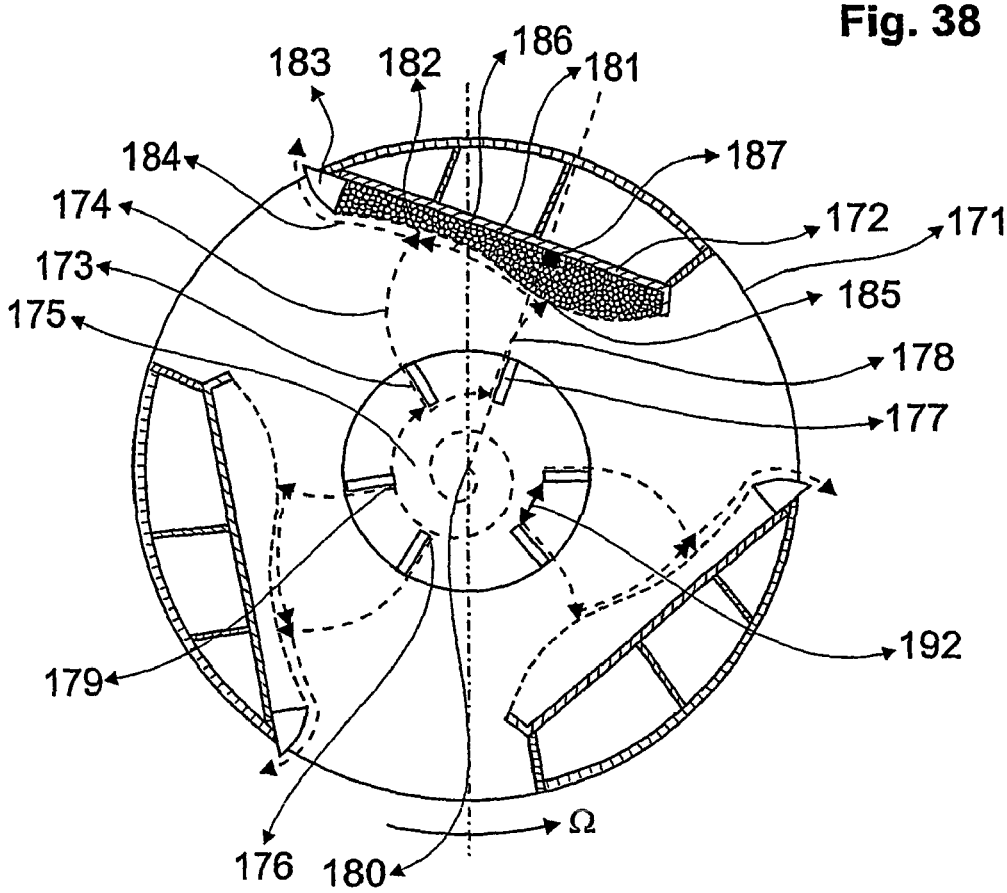
FIG. 38 shows, diagrammatically, a fourth embodiment of a non-symmetrical rotor.

FIG. 38 shows, diagrammatically, a fourth embodiment of a non-symmetrical rotor (171) where the chamber member (172) is associated with two guide members, specifically a first guide member (173) by means of which a first portion (174) of the material metered onto the central surface (175) is picked up by a first central feed (176), and a second guide member (177) by means of which a second portion (178) of said metered material is picked up by a second central feed (179), which second central feed (179) is at a location behind the radial line from said axis of rotation (180) with the first central feed (176) thereon, viewed in the direction of rotation. The first portion (174) of said material impinges on the autogenous chamber bed (181) at a first impingement location (182) and from there moves (184) in the direction of the chamber tip (183). The second portion (178) of said material impinges on said autogenous chamber bed (181) at a second impingement location (185) that is located behind said first impingement location (182), which second portion (178) moves (186) from there in the direction of the chamber tip (183). During this movement the second portion (178)(186) of said material passes the first impingement location (182), where said second portion (186) of said material is struck fully by the impinging first portion (174) of said material. What is achieved by this means is that the streams of the first (174) and the second (178) portion of the material continually impinge fully on one another at said first impingement location (182), which yields a high intensity of comminution, whilst the autogenous chamber bed (181) is continually refreshed.

The first impingement location (182) can be accurately determined with the aid of the positioning of the guide member (173)(177) and the same applies in respect of the second impingement location (185). The first impingement location (182) can be displaced further towards chamber tip (183), but also further towards tangential location (187). The positions of the first (182) and second (185) impingement locations can be located further apart, but also closer together, even such that said first (182) and second (185) impingement locations are (virtually) coincident.

Figure 39:
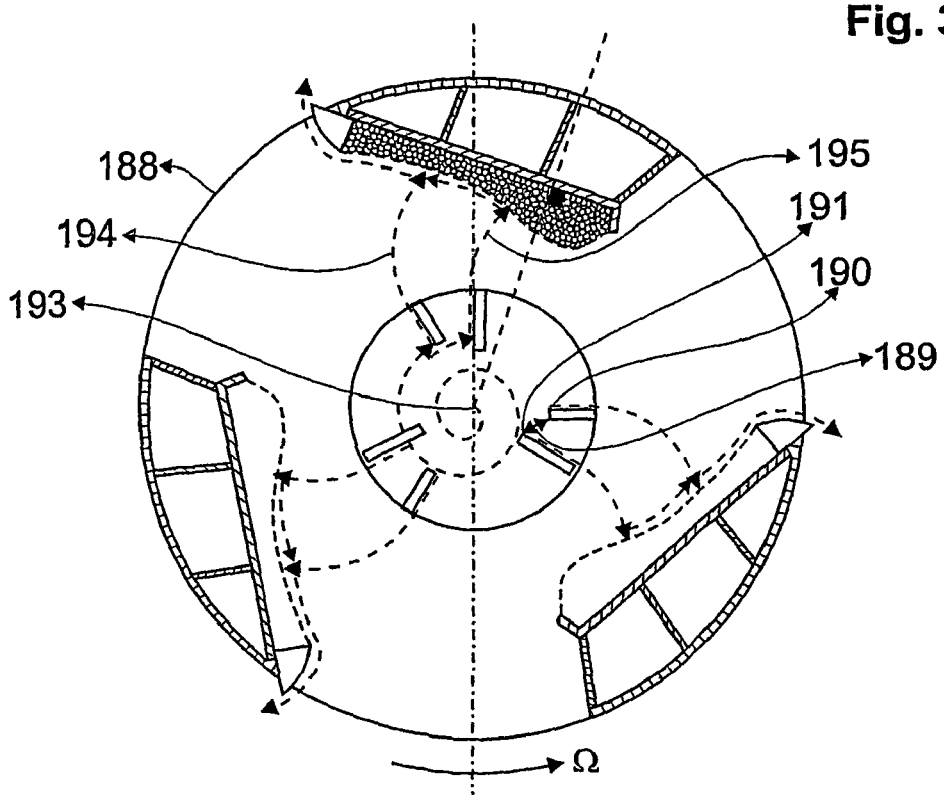
FIG. 39 shows, diagrammatically, a fifth embodiment of a non-symmetrical rotor.

FIG. 39 shows, diagrammatically, a fifth embodiment of a non-symmetrical rotor (188) where the distance (189) between the first (190) and the second (191) central feed has been changed (smaller here) compared with the corresponding distance (192) in the rotor in FIG. 38, whilst a different radial distance from the axis of rotation (193) to the first (190) and second (191) central feed has also been chosen; here the second (191) central feed is a smaller distance away from the axis of rotation (193) than is said first (190) central feed. This makes it possible accurately to control the size of the first (194) and second (195) amounts of said material.

Figure 40:
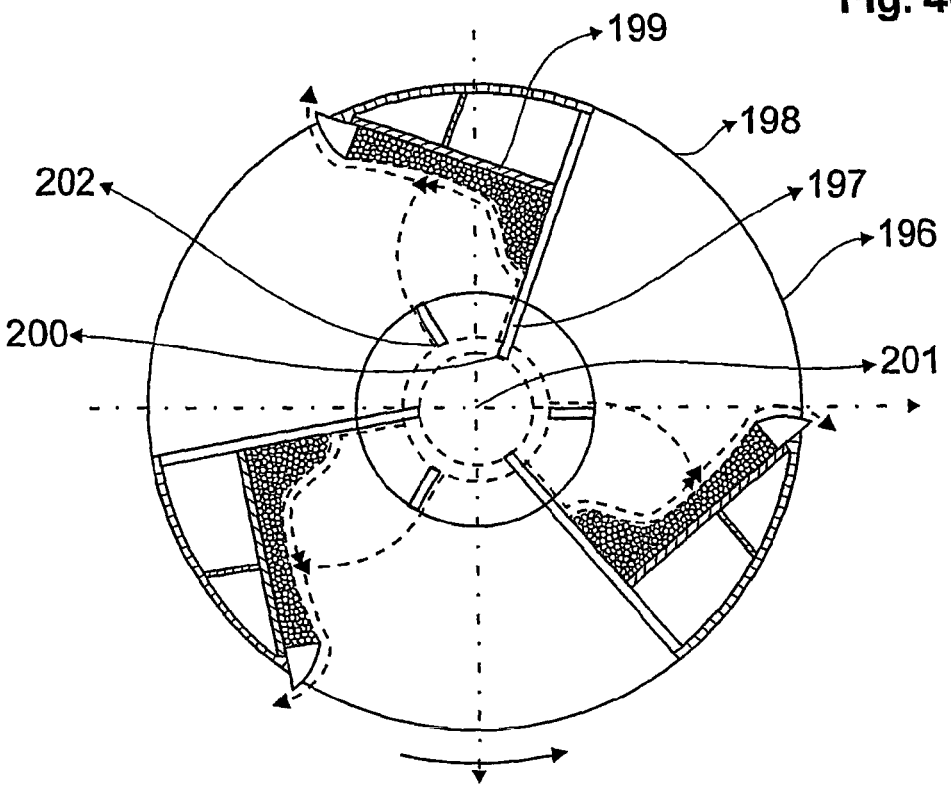
FIG. 40 shows, diagrammatically, a sixth embodiment of a non-symmetrical rotor.

FIG. 40 shows, diagrammatically, a sixth embodiment of a non-symmetrical rotor (196), where the second guide member (197) has been continued in the radial direction towards the outer edge (198) of the rotor (196), the chamber wall (199) being oriented perpendicularly to said continued guide member (197); at the same time the second central feed (200) is a smaller radial distance away from the axis of rotation (201) than is the first central feed (202).

Figure 41:
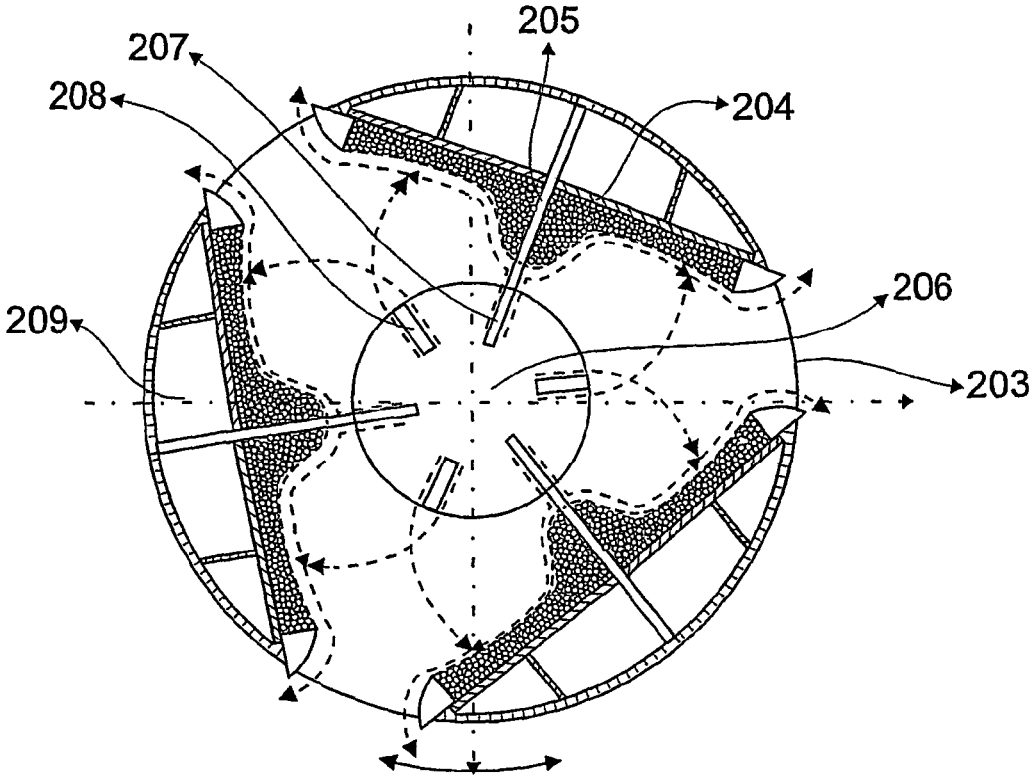
FIG. 41 shows, diagrammatically, a fifth embodiment of a symmetrical rotor.

FIG. 41 shows, diagrammatically, a fifth embodiment of a symmetrical rotor (203) that is constructed with three symmetrical chamber members (204), the partition (205) of which is continued to the central surface (206) (essentially as in FIG. 40), so that the first part (207) of said partition (205) acts as a second symmetrical guide member. The first guide member (208) is also of symmetrical construction (radial in this case) and is arranged centrally between the chamber members (204)(209).

It is clear that in the configurations as shown in FIGS. 38 to 41 as well the guide members can be constructed in a different shape and can be positioned in a different manner (as has been indicated above), by means of which the position of the first and second impingement locations can be determined. It is also possible to arrange an impingement member at the location of the first impingement location (as has been indicated above), as a result of which the impact of the first portion of the material on the second portion of the material takes place even more intensively. An impact member can also be arranged at the location of the second impingement location. It is even possible to allow both the first and second portions of the material to impinge on the chamber tip, which for this purpose has to be constructed as an impact member that also acts as chamber tip.

The invention also provides the possibility that the material, after it is propelled outwards from the rotor, is collected by a stationary impact member that is arranged around the rotor and can be constructed as a channel construction in which a stationary autogenous chamber bed of own material builds up or in the form of a stationary armoured ring that is smooth or can be constructed with a knurled shape; and it is even possible to create a hybrid combination by arranging armoured plates in the stationary autogenous chamber bed.

The above descriptions of specific embodiments of the present invention are given with a view to illustrative and descriptive purposes. They are not intended to be an exhaustive list or to restrict the invention to the precise forms given, and having due regard for the above explanation, many modifications and variations are, of course, possible. The embodiments have been selected and described in order to describe the principles of the invention and the practical application possibilities thereof in the best possible way in order thus to enable others skilled in the art to make use in an optimum manner of the invention and the diverse embodiments with the various modifications suitable for the specific intended use. The intention is that the scope of the invention is described by the appended claims according to reading and interpretation in accordance with generally accepted legal principles, such as the principle of equivalence and the revision of components.

The invention claimed is:

1. Device for accelerating a stream of material, comprising:

a rotor that can be rotated about a vertical axis of rotation in at least one direction of rotation, said rotor being supported on a shaft having a shaft axis coincident with said axis of rotation;

a central member carried by said rotor and provided with an essentially circular central surface having a center coincident with said axis of rotation;

an edge member carried by said rotor and provided with an edge surface that extends between an outer edge of said central member and an outer edge of said rotor;

at least one chamber member carried by said rotor and provided with at least one chamber wall and at least one chamber tip;

at least a portion of the inside of said at least one chamber wall, which inside faces said axis of rotation, being oriented essentially transversely at a tangential location to the radial plane from said axis of rotation and extending towards said chamber tip, which is located close to said outer edge of said rotor, such that a continuous layer of material settles as an autogenous chamber bed, on at least a portion of said inside of said chamber wall under the influence of centrifugal force;

said autogenous chamber bed extending along said inside of said chamber wall towards said chamber tip;

said rotor being provided with at least one guide member associated with said chamber member and carried by said rotor;

said guide member being provided with at least one guide surface that extends towards said outer edge of said rotor between a central feed and a release end;

said central surface having an outer edge which extends at least as far as said central feed;

said release end being a smaller radial distance away from said axis of rotation than said chamber member for, respectively, picking up by said central feed at least a portion of material that is metered with a metering member onto said central surface, guiding picked up material along said guide surface under the influence of centrifugal force, thereafter guiding material into a spiral path directed backwards, viewed in the direction of rotation and viewed from a standpoint moving with said guide member;

the position of said guide member being selected such that said material moving along said spiral path impinges on said chamber member at a predetermined impingement location in said chamber bed that is located behind a radial line from said axis of rotation with said chamber tip thereon and in front of the radial line from said axis of rotation with said tangential location thereon, viewed in the direction of rotation; thereafter said material moving from said impingement location along said autogenous chamber bed in the direction of said chamber tip under the influence of centrifugal force, and being propelled outwards from said rotor.

2. The device according to claim 1, wherein said outer edge of said central surface extends at least as far as said release end.

3. The device according to claim 2, wherein said outer edge of said central surface is located at a level above said edge surface; said difference in level being indicated as a first difference in level.

4. The device according to claim 3, wherein said first difference in level is selected such that said material moving along said spiral path, when leaving said central surface, moves to said chamber member without touching said edge surface.

5. The device according to claim 4, wherein said first difference in level is at least 25 mm.

6. The device according to claim 4, wherein said first difference in level is at least 50 mm.

7. The device according to claim 4, wherein said first difference in level is at least 75 mm.

8. The device according to claim 4, wherein said first difference in level is at least 100 mm.

9. The device according to claim 1, wherein the top edge of the section of said rotor that carries said central member is located at a level above the top edge of the section of the rotor that carries said edge member.

10. The device according to claim 1, further comprising a supporting member located between said rotor and said central member for carrying said central member, such that said central surface is located at a level above said edge surface.

11. The device according to claim 1, wherein said guide member comprises at least one guide chamber having a guide wall and a guide tip, the inside of the guide wall facing said axis of rotation and being at least partially oriented transversely to the radial plane from said axis of rotation, such that an autogenous guide bed of material settles on said guide wall, under the influence of centrifugal force.

12. The device according to claim 1, wherein said rotor comprises a first rotor blade and a second rotor blade; said rotor blades having an essentially identical peripheral shape and being arranged parallel to one another; said first rotor blade being carried by said shaft and being provided with said central surface; said second rotor blade being supported on said first rotor blade and being provided with a circular metering opening having a center coincident with said axis of rotation, for metering material with a metering member onto said central surface, said chamber wall extending between said rotor blades.

13. The device according to claim 1, wherein the top edge of said chamber member is located at a level above the top edge of said guide member, and the difference in level is indicated as the second difference in level.

14. The device according to claim 13, wherein the second difference in level is at least 25 mm.

15. The device according to claim 13, wherein the second difference in level is at least 50 mm.

16. The device according to claim 1, wherein the chamber member is provided with a cover plate that extends from the top edge of said chamber wall towards said axis of rotation.

17. The device according to claim 1, wherein the inside of said chamber wall describes a surface of revolution having an axis of revolution coincident with said axis of rotation; said chamber wall having at least one ejection opening which extends in front of and alongside said chamber tip, viewed in the direction of rotation.

18. The device according to claim 17, wherein said surface of revolution describes a cylindrical shape.

19. The device according to claim 1, wherein the contact surface along said inside of said chamber wall is oriented perpendicularly, at a tangential location, to a radial surface from said axis of rotation.

20. The device according to claim 1, wherein the inside of the chamber wall describes an arc of a circle having a center coincident with said axis of rotation.

21. The device according to claim 1, wherein the inside of said chamber wall extends behind the impingement location, viewed in the direction of rotation, as a section of the chamber wall located at the back, such that a continuous layer of material settles, as an autogenous chamber bed, on said portion of said chamber wall located at the back, under the influence of centrifugal force.

22. The device according to claim 1, wherein a first portion of said metered material is guided by the guide member towards the impingement location and a second portion of metered material is guided from a supply location towards a feed location; said supply location extending along part of the outer edge of said central surface, behind the radial line from said axis of rotation with the central feed thereon; said second portion moving outwards from said supply location along said edge surface along a virtually radially oriented feed stream, under the influence of the rotary movement of the rotor and viewed from a stationary standpoint, and into a spiral feed stream directed backwards, viewed from a standpoint moving with said guide member and viewed in the direction of rotation; said feed location being located on said autogenous chamber bed, behind the radial line from said axis of rotation with said impingement location thereon, viewed in the direction of rotation; said second portion of material moving from said feed location along said autogenous chamber bed in the direction of said impingement location, under the influence of centrifugal force, such that said second portion of material is struck at said impingement location by said first portion of material, after which said material moves from said impingement location in the direction of said chamber tip.

23. The device according to claim 1, wherein said rotor is provided with a first guide member and a second guide member which are associated with said chamber member; said second guide member being located behind said first guide member, viewed in the direction of rotation; said first guide member guiding a first portion of material towards said impingement location and said second guide member guiding a second portion of material towards a feed location; said second portion of material moving from said feed location along said autogenous chamber bed in the direction of said impingement location under the influence of centrifugal force, such that said second portion of material is struck at said impingement location by said first portion of material after which the material moves towards said chamber tip.

24. The device according to claim 22, wherein said impingement location is a greater radial distance away from the axis of rotation than is the feed location.

25. The device according to claim 23, wherein the first guide member has a first central feed and the second guide member has a second central feed, and the second central feed is located a smaller radial distance away from the axis of rotation than is the first central feed.

26. The device according to claim 1, wherein the central member is formed by a removable separate central wear plate that is carried by said rotor and is provided with at least one opening.

27. The device according to claim 1, wherein said edge member is formed by a removable separate edge wear plate that is provided with at least one opening.

28. The device according to claim 1, wherein the position of the guide member is determined by an angle between the radial line with said release end thereon and the radial line with the location thereon where the spiral path and the path that said chamber member describes intersect one another.

29. The device according to claim 28, wherein the chamber member is symmetrical with respect to a first radial plane of symmetry that extends from said axis of rotation; said symmetrical chamber member comprising a chamber wall and a chamber tip directed forwards, and a chamber wall and a chamber tip directed backwards, viewed in the direction of rotation; said symmetrical chamber member being associated with at least one guide member that is symmetrical with respect to a second radial plane of symmetry that extends from said axis of rotation.

30. The device according to claim 29, wherein said chamber member is provided with a partition surface that extends from said chamber wall along said first radial plane of symmetry towards said axis of rotation.

31. The device according to claim 29, wherein said chamber member is provided with a removable impact member that is arranged at said impingement location in said chamber bed and is carried by said chamber member; said impact member having an impact surface that is oriented transversely to said spiral path.

32. The device according to claim 31, wherein said impact member is provided with a metal impact surface.

33. The device according to claim 31, wherein said impact surface is not completely surrounded by said autogenous chamber bed.

34. The device according to claim 31, wherein said autogenous chamber bed extends at least from the front of said impact member towards said chamber tip, viewed in the direction of rotation.

35. The device according to claim 31, wherein said impact member is symmetrical with respect to said first radial plane of symmetry.

36. The device according to claim 29, wherein said symmetrical guide member has a cylindrical guide surface having a cylindrical axis which runs parallel to said axis of rotation.

37. The device according to claim 29, wherein the symmetrical guide member has a guide surface that describes an arc.

38. The device according to claim 37, wherein the arc describes at least 180°.

39. The device according to claim 1, wherein the guide surface is directed forwards such that the radial line from said axis of rotation with said release end thereon is at a location in front of the radial line from the axis of rotation with the central feed thereon.

40. The device according to claim 1, wherein the guide surface is directed backwards, such that the radial line from the axis of rotation with the release end thereon is at a location behind the radial line from the axis of rotation with the central feed thereon.

41. The device according to claim 1, wherein the central feed of a first guide member is a different radial distance away from the axis of rotation than the central feed of a second guide member.

42. The device according to claim 1, wherein said guide surface is made of metal.

43. The device according to claim 1, wherein said guide surface is at least partially made of hard metal.

44. The device according to claim 1, wherein said chamber member is symmetrical with respect to a first radial plane of symmetry from the axis of rotation; the chamber wall being oriented, at least at the location of said radial plane of symmetry, perpendicularly to said first radial plane of symmetry, and the chamber tips being essentially cylindrical such that an autogenous chamber bed forms between said chamber tips, which have a diameter of at least 50 mm and at most 150 mm.

45. The device according to claim 1, wherein said guide member is symmetrical with respect to a second radial plane of symmetry from the axis of rotation; said guide member being constructed as a guide chamber having a chamber wall which is oriented, at least at the location of the first radial plane of symmetry, perpendicularly to the first radial plane of symmetry and the chamber tips are essentially cylindrical, such that an autogenous guide bed is able to settle between the tips, which have a diameter of at least 25 mm and at most 125 mm.

46. The device according to claim 1, wherein said chamber tip has a sandwich construction that is made up of at least three successive layers, which alternately have a greater and a lesser resistance to wear.

47. The device according to claim 46, wherein the sandwich construction is made up of at least five successive layers.

48. The device according to claim 46, wherein the top and the bottom layer have a greater resistance to wear.

49. The device according to claim 46, wherein the layers are arranged at an inclination with respect to the plane of rotation.

* * * * *